US008485148B2

(12) United States Patent
Schiemann

(10) Patent No.: US 8,485,148 B2
(45) Date of Patent: Jul. 16, 2013

(54) METHOD AND DEVICE FOR CONTROLLING A HYDRAULIC ACTUATOR

(75) Inventor: Juergen Schiemann, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 1187 days.

(21) Appl. No.: 12/156,146

(22) Filed: May 30, 2008

(65) Prior Publication Data

US 2009/0014672 A1 Jan. 15, 2009
US 2009/0206288 A2 Aug. 20, 2009

(30) Foreign Application Priority Data

Jun. 1, 2007 (DE) ..... 10 2007 025 619

(51) Int. Cl.
*F01L 9/02* (2006.01)

(52) U.S. Cl.
USPC ..... 123/90.12; 361/153

(58) Field of Classification Search
USPC ..... 123/90.12, 90.13, 90.15; 361/152–154
See application file for complete search history.

(56) References Cited

U.S. PATENT DOCUMENTS 6,067,946 A * 5/2000 Bunker et al. ..... 123/90.12
6,321,703 B1 * 11/2001 Diehl et al. ..... 123/90.12
6,505,113 B2 1/2003 Eichenseher et al.
6,739,293 B2 * 5/2004 Turner et al. ..... 123/90.12
6,752,106 B2 * 6/2004 Hedman ..... 123/90.12
6,966,285 B1 * 11/2005 Sun ..... 123/90.12
6,971,348 B1 * 12/2005 Sun ..... 123/90.15
7,044,092 B2 * 5/2006 Panciroli ..... 123/90.12
7,204,212 B2 * 4/2007 Donaldson ..... 123/90.12
7,341,028 B2 * 3/2008 Klose et al. ..... 123/90.12
7,380,528 B2 * 6/2008 Gaessler et al. ..... 123/90.12
7,644,688 B2 * 1/2010 Marriott et al. ..... 123/90.12
7,665,431 B2 * 2/2010 Sun ..... 123/90.12
7,677,212 B2 * 3/2010 Stretch ..... 123/90.12
7,866,286 B2 * 1/2011 Sun ..... 123/90.12
7,926,454 B2 * 4/2011 Hedman ..... 123/90.12

FOREIGN PATENT DOCUMENTS

DE 3806969 9/1989
DE 19839732 3/2000
DE 19918095 10/2000

(Continued)

*Primary Examiner* — Thomas Denion
*Assistant Examiner* — Daniel Bernstein
(74) *Attorney, Agent, or Firm* — Kenyon & Kenyon LLP

(57) ABSTRACT

A method, device, and control unit for controlling an actuator in open loop, particularly for a valve, preferably for a gas-exchange valve of an internal combustion engine, having at least one control valve for opening the valve and one control valve for closing the valve, each of the control valves being capable of being driven by at least one drive pulse whose duration determines a position on the positioning travel of the valve. The valve is opened/closed in one lift and/or a plurality of partial lifts and at least one drive pulse is assigned to each lift and/or each partial lift, and the valve is assigned at least one transducer which generates a signal that discloses values of a discrete positioning travel of the valve and of an assigned time and/or of a discrete instant and of an assigned positioning travel. The method for controlling the actuator includes:

a. Starting of a drive pulse having a setpoint duration of the drive pulse for opening and/or closing the valve,
b. Generating at least one signal, and
c. Correcting the setpoint duration of the drive pulse and/or of a following drive pulse assigned to the lift and/or to a partial lift, in accordance with the signal.

26 Claims, 9 Drawing Sheets

FOREIGN PATENT DOCUMENTS

| | | |
|---|---|---|
| DE | 102004022447 | 12/2005 |
| DE | 102005002384 | 7/2006 |
| DE | 102005002385 | 7/2006 |
| DE | 102005002387 | 7/2006 |

* cited by examiner

METHOD AND DEVICE FOR CONTROLLING A HYDRAULIC ACTUATOR

CROSS REFERENCE

This application claims benefit under 35 U.S.C. §119 of German Patent Application No. 102007025619.3, filed on Jun. 1, 2007, which is expressly incorporated herein by reference in its entirety.

FIELD OF THE INVENTION

The present invention relates to a method for controlling an actuator in open loop, particularly for a valve, preferably for a gas-exchange valve of an internal combustion engine, having at least one control valve for opening the valve and one control valve for closing the valve, each of the control valves being capable of being driven by at least one drive pulse whose duration determines a position on the positioning travel of the valve. The present invention further relates to a corresponding device and a corresponding control unit.

BACKGROUND INFORMATION

Conventional methods of this kind for controlling an actuator, particularly for hydraulic actuators of the type indicated at the outset, are used for actuating valves such as the gas-exchange valves of an internal combustion engine or of a compressor, or for actuating flaps like, for example, rapid intake-manifold flaps in the intake manifold of a cylinder of an internal combustion engine, or for actuating other mechanisms. Such a hydraulic valve actuator is driven as a function of various operating parameters of the engine with the aid of an electronic control unit generally controlled by software. In this context, suitable drive variables, i.e., setpoint values for the necessary actuator drive signals are calculated based on control setpoint selections of a gas-exchange valve, e.g., for lift and timing, taking system state variables such as supply voltage, combustion-chamber pressure, hydraulic pressure and temperature into account, and the drive signals are generated in accordance with these setpoint values.

In the case of a hydraulic actuator described, for example, in German Patent Application No. DE 10 2004 022 447 A1, which is used in an electrohydraulic, camshaft-free positioning system for gas-exchange valves (EHVC), one drive signal each, made up of at least one pulse, is needed for controlling a control valve (MV1) on the high-pressure side determining the opening operation of an EHVC actuator, and for controlling a control valve (MV2) on the low-pressure side responsible for the closing operation. In this case, a single drive pulse determines the instant and duration for an opening of the control valve on the high-pressure side or for a closing of the control valve on the low-pressure side.

In this conventional EHVC system, in principle, lift and timing as well as opening velocity and closing velocity of the gas-exchange valves of an internal combustion engine are able to be freely programmed. This permits a flexible control of the gas exchange of the internal combustion engine, whereby the operational performance of the internal combustion engine, as well as its specific fuel consumption and vehicle emissions can be improved.

In principle, a method is able to be implemented for controlling a hydraulic valve actuator without feedback about the positioning operations themselves, that is, as a pure open-loop control. Suitable methods and control functions for controlling the lift of a hydraulic actuator are described in German Patent Applications DE 10 2005 002 385 A1 and DE 10 2005 002 384 A1.

A general disadvantage of these conventional design approaches is that they have to rely on a very good prediction of the possible actuator progressions, and therefore involve a high modeling and/or application expenditure in order to achieve the required actuator precision. The high expenditure relates primarily to the sufficiently accurate description of the multitude of dependencies, in connection with which influences such as oil pressure, oil temperature, viscosity and gas forces must be taken into account. In part, they are rapidly changeable, such as the oil pressure, and/or are difficult to model, like the gas forces, for instance.

In this problem area, which relates in the same way to other conventional camshaft-free valve controls as well, conventional design approaches start out from a feedback about a positioning operation. A suitable transducer is needed for that purpose.

German Patent No. DE 198 39 732 C2 describes a piezoelectric-hydraulic actuator for a gas-exchange valve, in which an electronic travel transducer is assigned to the actuator piston.

German Patent No. DE 199 18 095 C1 describes a circuit for controlling an electromechanically actuated gas-exchange valve that is equipped with a position sensor. Based on the position signal, a placement controller generates a drive signal for an output stage of the gas-exchange valve.

German Patent No. DE 38 06 969 A1 describes another electrohydraulic actuator for a gas-exchange valve, in which the valve-lifting curve is adjustable to a predefined setpoint-value characteristic, a travel sensor being provided which senses the position of the gas-exchange valve and supplies the position to a controller. It controls the current of a proportional magnet, which actuates a continuously adjustable control slide for regulating the hydraulic positioning force.

The conventional design approaches are based on the continuous, position-dependent regulation of a proportional drive variable, e.g., the current or the voltage of an output stage, whereby the force of the actuator and therefore the movement characteristic or the velocity of the gas-exchange valve is altered in the manner desired, in particular is regulated to a setpoint characteristic.

In the case of the EHVC system indicated, the basic requirement for a practical application or transfer of the conventional design approaches, i.e., for a regulation of the movement characteristic is not fulfilled, since a proportional driving and, hence, a positioning-force regulation is not possible as a matter of principle.

On the other hand, design approaches for controlling an EHVC actuator are known, which make use of an at least indirect feedback about the actuating characteristic. German Patent Application Nos. DE 10 2005 002 385 A1 and DE 10 2005 002 387 A1 describe adapting a lift control on the basis of a feedback about the positioning operations or adjusted valve lifts, in order to reduce or avoid control errors developing in response to a drift from actuator parameters.

Moreover, German Patent Application No. DE 10 2005 002 385 A1 also describes a regulation of the valve lift from cycle to cycle, which likewise starts out from a feedback about the valve lift. In that case, a correcting quantity, which is ascertained on the basis of positioning errors of preceding positioning operations, is added to a setpoint value of a driving duration of the control valve on the high-pressure side, the setpoint value being calculated based on a model.

The high modeling and/or application expenditure needed for the pure control is not substantially reduced in the above design approaches. In addition, errors in determining influence variables are not or are scarcely offset by an adaptation, and are only partially offset by a cycle-based regulation. Therefore, in spite of available feedback about the adjusted lifts, rapid changes of influence variables such as the oil pressure or of setpoint values of individual valve parameters almost unavoidably lead to noticeable transient deviations between actual and setpoint values of the valve lift.

SUMMARY

An object of the present invention is to provide a valve-lift control, improved on the basis of a positioning-travel feedback, which ensures the required high actuator precision even in the event of highly dynamic changes of influence variables and large possible errors in determining such influence variables, and in particular, avoids transient errors of the set valve lift.

This objective may be achieved according to the present invention in that the valve is opened/closed in one lift and/or a plurality of partial lifts, and at least one drive pulse is assigned to each lift and/or each partial lift, and that the valve is assigned at least one transducer which generates a signal that discloses values of a discrete positioning travel of the valve and of an assigned time and/or of a discrete instant and of an assigned positioning travel, and that the method for controlling the actuator is carried out using the following steps:

Starting of a drive pulse having a setpoint duration of the drive pulse for opening and/or closing the valve, Generating at least one signal, and Correcting the setpoint duration of the drive pulse and/or of a following drive pulse assigned to the lift and/or to a partial lift, in accordance with the signal.

According to an example embodiment of the present invention, a lift control is provided in which at least once during the opening operation of a hydraulic actuator, the positioning travel of the actuator or the deviation of the positioning travel from a predefined or anticipated characteristic, or a measure for the indicated positioning travel or the indicated deviation is determined on the basis of a sensor signal which contains a suitable feedback about this positioning operation, and is used to improve the calculation of a drive variable that is needed or used to adjust the desired valve lift. On this basis, even during the opening operation, an at least one-time, possibly also successive (iterative) correction of a drive variable, particularly of a driving time of the control valve (MV1) on the high-pressure side which determines the resulting lift, is carried out.

The example embodiment represents an open-loop control, since only the duration of a positioning operation is influenced. Thus, the correction according to the example embodiment of the present invention, which shortens or lengthens this duration for the purpose of more exactly adjusting the controlled variable, i.e., the "lift," still—like a pure open-loop control, which has no feedback about the positioning operation—has to rely on the sufficiently good prediction of the further movement characteristic.

In contrast to the conventional closed-loop controls described above, for camshaft-free, variable valve controls, in the example embodiment of the present invention, the movement of a gas-exchange valve as a travel-time characteristic is not influenced by the correction according to the example embodiment of the present invention, but rather only the duration of a positioning operation is adapted. Therefore, the feedback about the movement characteristic also contains no information whatsoever about an implemented correction of the driving, since this correction really does not become effective immediately, but only at the end.

Particularly in the case of a sequence of several correction steps according to the present invention or in the case of an iterative implementation of the method, the quality of the control, that is, the precision of the set valve lift, is determined only by a single correction, namely, the last correction prior to the actual end of the driving.

The example method according to the present invention is also and precisely usable with advantage in the case of those positioning systems (like the electrohydraulic valve control indicated) in which a proportional driving, i.e., time-dependent regulation of the positioning force is not generally possible, so that the conventional closed-loop control methods cannot be used.

The improvements attainable using the example design approaches compared to the pure open-loop control are based first of all on the fact that, for example, a model of the positioning operation, which is used for the prediction still necessary, is able to be improved on the basis of the feedback about the positioning travel used in the present invention, and secondly, the time interval of the acquisition of a feedback relative to the beginning of a positioning operation is accompanied by a corresponding shortening of the prediction interval up to the end of the operation. In the case of an iterative variant of the method, this prediction interval is shortened successively.

It is advantageously provided that the method of the present invention is used for controlling an opening/closing, e.g., of a gas-exchange valve in one lift and/or in a plurality of partial lifts, at least one signal (U_sgev) being generated for each lift and/or partial lift, and a drive pulse being corrected in accordance with this signal (U_sgev).

For the drive correction according to the example embodiment of the present invention, advantageously a position on the positioning travel of the hydraulic actuator or of the gas-exchange valve actuated by it is acquired at at least one predefined instant. For example, this is possible on the basis of conventional travel sensors which supply a proportional travel signal.

In this case, preferably a deviation of the measured position of the gas-exchange valve or actuator from a position anticipated at the given instant is determined. For example, it is thereby possible to determine a correction of the driving time of the control valve on the high-pressure side in such a way that the deviation ascertained is precisely compensated for at a velocity of the actuator predicted for the end of the positioning operation. This design approach is described in greater detail below as a first exemplary embodiment of the present invention.

Alternatively and equally advantageously, an instant is determined at which the gas-exchange valve reaches a predetermined position. For example, for this case, conventional position encoders or increment encoders are suitable which generate a pulse or a signal edge at one or more positions. For instance, it is thereby possible to determine a correction of the driving time of the control valve on the high-pressure side in such a way that the ascertained "lateness" or "earliness" is offset precisely. This design approach is described in greater detail further below as a second exemplary embodiment of the present invention.

These design approaches are able to be further refined and improved in various ways. Thus, for example, from an indicated deviation, a velocity error may be inferred and introduced into the determination of the correction according to the present invention.

Moreover, for example, in the event a feedback about the positioning operation is acquired repeatedly, not only the correction itself according to the present invention may be implemented repeatedly with advantage, but also, for example, a movement model which describes an anticipated characteristic and which is used for calculating the correction may be improved or rather adapted on the basis of ascertained deviations from precisely this setpoint characteristic.

Advantageously, an example method of the present invention may also be designed iteratively, that is, with steps repeated regularly and possibly in rapid succession, in which, for example, in each case a positioning-travel feedback is acquired, and immediately following, a drive variable determining the lift is corrected.

Such exemplary implementations of the method according to the present invention may advantageously be almost completely rendered with the aid of signal processing, that is, with signal-based algorithms for determining the drive corrections.

In these embodiments, a small model-based constituent in the correction calculation according to the present invention is needed only for predicting the movement of the actuator in a brief after-run phase after the drive of control valve (MV1) on the high-pressure side is de-energized, and specifically for predicting the lift increase in this phase.

A third exemplary embodiment represents the last-named class of design approaches according to the present invention by way of example. The illustratively indicated and very simple iterative correction method is based on the direct evaluation of the positioning travel and velocity for the continual determination of the remaining lift time still necessary, and therefore the driving time in total. This leads—during the already ongoing generation of the drive pulse of a high-pressure-side control valve (MV1) by the appropriate pulse-output unit—to a successive correction of the driving time, that is, of the setpoint value, transmitted to the pulse-output unit, for the pulse length of the already ongoing drive pulse. A prerequisite for this method is a sensor which makes it possible to determine the positioning travel of an EHVC actuator with high accuracy and sampling rate and with not too great a (known) latency. In this context, the necessary sampling rate may be reduced decidedly by a temporal refinement of a roughly sampled input signal, e.g., by the use of a model-based or signal-based extrapolation.

In one advantageous further refinement, for example, the model-based part of the calculations, possibly also the signal-evaluation method, is linked to an adaptation which compensates for model errors or errors caused by drift.

In addition to the reliable fulfillment of the demands for actuator precision, the special advantages of the iterative design variants illustrated by the third exemplary embodiment lie primarily in its simplicity, which in the embodiment indicated by way of example, is expressed in the virtually complete absence of modelings, be they of the actuator behavior and/or of the influence variables. The necessary size of code and data, as well as the application expenditure are correspondingly small.

As far as the actuator precision is concerned, even the greatest potential positioning errors are completely compensated for and therefore prevented. Such large errors may occur, for example, in an operating state with high performance demand on the engine in the event of a combustion miss, thus, given the almost complete omission of a normally expected high gas force counteracting the opening of an exhaust valve, if the driving time of the exhaust valve calculated for the normal case is not corrected. In the design approach presently described, such circumstances are corrected automatically, since the faster opening of the exhaust valve leads to a corresponding (sharp) shortening of the driving time.

The present invention further relates to a device, particularly an internal combustion engine, preferably for implementing the method indicated above, having at least one hydraulically actuated valve.

According to example embodiments of the present invention, the valve is assigned a transducer that generates a signal, particularly an electrical signal, corresponding to a positioning travel of the valve.

Advantageously, the hydraulically actuated valve may be a gas-exchange valve to which hydraulic pressure is applied with the aid of a control valve on the high-pressures side and a control valve on the low-pressures side, and which is thus able to be opened and closed. In particular, the control valves are switching valves.

According to a further refinement of the present invention, the control valve on the high-pressure side and the control valve on the low-pressure side are electrically driven.

In one advantageous embodiment of the present invention, the opening of the control valve on the high-pressure side while the control valve on the low-pressure side is in the closed state causes the gas-exchange valve to open, and the opening of the control valve on the low-pressure side while the control valve on the high-pressure side is in the closed state causes the gas-exchange valve to close.

Moreover, the present invention relates to a control unit for controlling a hydraulic actuator using a method indicated above. It is provided that the control unit is equipped with means for driving at least one control valve of the hydraulic actuator and for acquiring the signal of a transducer.

The present invention also relates to a method for controlling a valve in open loop, especially a gas-exchange valve of an internal combustion engine, the valve being assigned a transducer that generates a signal, particularly an electrical signal, corresponding to a positioning travel of the valve, and the valve being opened and closed with the aid of a drive pulse. According to the present invention, the actual value of the positioning travel of the gas-exchange valve may be continually sampled, and a setpoint value for the duration of the drive pulse may be continually ascertained from the actual value of the positioning travel.

Furthermore, it is advantageously provided that the setpoint value for the duration of the drive pulse is ascertained in that, from a positioning travel covered at the instant of a sampling and from a velocity of the valve at the instant of the sampling, a time duration is ascertained after which a setpoint value of the positioning travel is reached, and that the pulse duration is determined from the time duration, and the end of the drive pulse is determined from the pulse duration.

According to a further refinement of the present invention, a remaining pulse duration (tm1_remain) is ascertained from the quotient of the difference between setpoint positioning travel (l_setpoint) and actual positioning travel (s_gev) with respect to opening velocity (v_gev)(tm1_remain=(l_setpoint−gev)/v_gev).

Advantageously, it is further provided that the remaining pulse duration is corrected by an effective return-travel time (dt_rt_eff) of an armature of the electrically driven control valve (tm1_remain=(l_setpoint−s_gev)/v_gev−dt_rt_eff).

In one advantageous specific embodiment of the present invention, effective return-travel time (dt_rt_eff) is determined from state variables of the internal combustion engine, particularly pressure (poil) and temperature (Toil) of a hydraulic oil of the hydraulic valve actuation, as well as opening velocity (v_gev) of the gas-exchange valve (dt_rt_eff=C0(poil, Toil)+C1(poil, Toil)*v_gev).

Finally, it is advantageously provided that effective return-travel time (dt_rt_eff) is ascertained from a program map. In particular, the program map corresponds to the equation: dt_rt_eff=C0(poil, Toil)+C1(poil, Toil)*v_gev.

BRIEF DESCRIPTION OF THE DRAWINGS

Below, exemplary embodiments of the present invention are explained in greater detail with reference to the figures.

DETAILED DESCRIPTION OF EXAMPLE EMBODIMENTS

Figure 1:
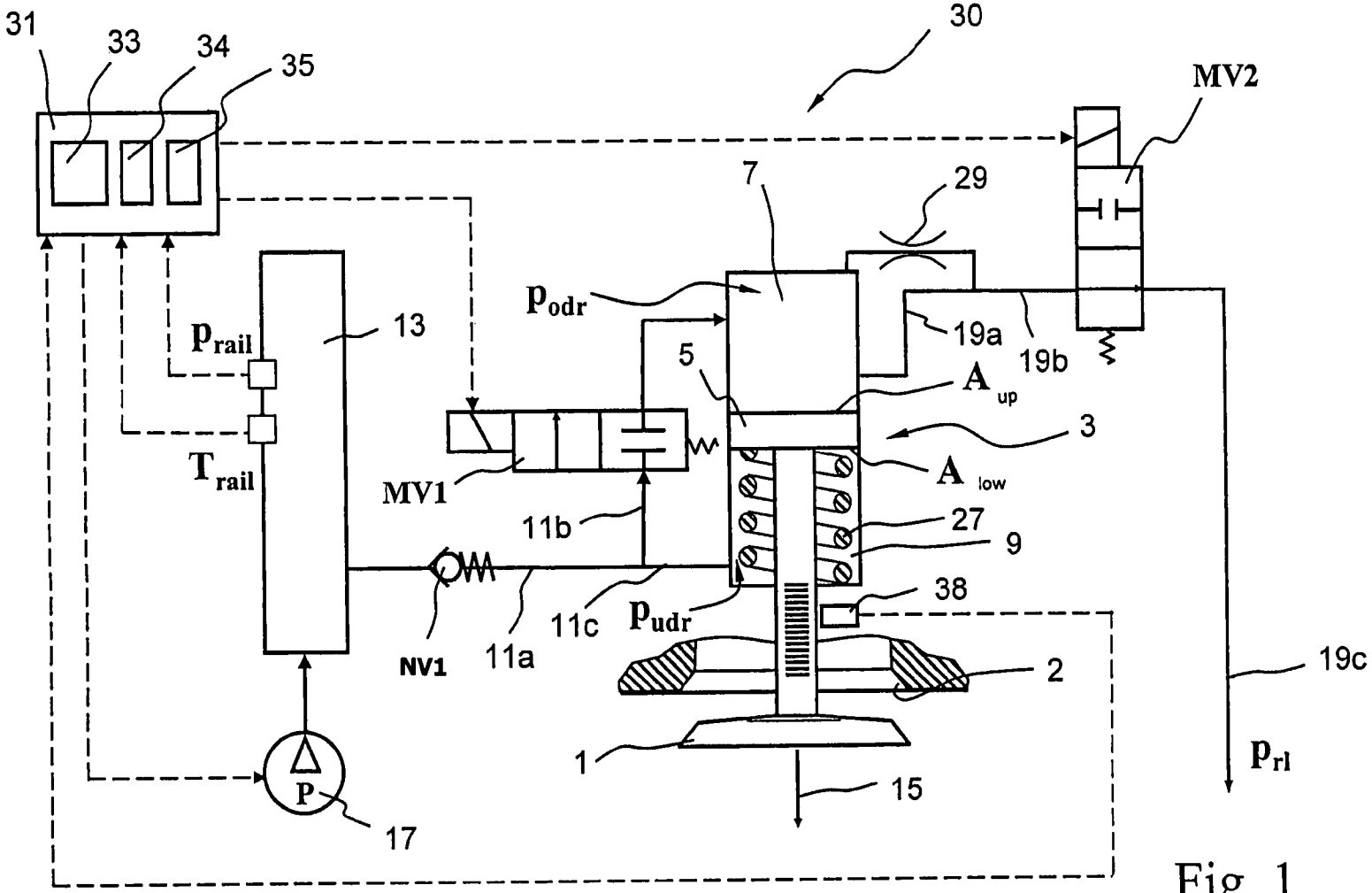
FIG. 1 shows an exemplary embodiment of an electrohydraulic valve control (EHVC).

FIG. 1 shows schematically a conventional exemplary embodiment of an electrohydraulic valve control (EHVC), based on which the control method according to the present invention is intended to be carried out. However, the present invention is not restricted to this exemplary use.

Actuator 30 shown in FIG. 1 is used by way of example for actuating a gas-exchange valve (GEV) 1 of an internal combustion engine. Gas-exchange valve 1 may be implemented as an intake valve or exhaust valve. In the closed state, it rests on a valve seat 2.

Instead of a single gas-exchange valve 1, in elaboration of the arrangement sketched in FIG. 1, a pair of interconnected gas-exchange valves (double-acting valve) may also be actuated together, in particular may be synchronously opened and closed, by a single hydraulic actuator. Hereinafter, when a gas-exchange valve 1 is mentioned, a double-acting valve along the lines of this expanded arrangement can always be meant, as well.

Gas-exchange valve 1 is actuated by a hydraulic working cylinder 3, which represents the central mechanical-hydraulic component of an electrohydraulic actuator 30. Actuator 30 shown by way of example in FIG. 1 also includes a first control valve MV1 and a second control valve MV2. In addition, actuator 30 includes hydraulic lines 11 as well as 19*a* and 19*b*, a valve brake 29 and an optional non-return valve NV1. In typical designs of an actuator 30, the indicated components are integrated in one structural unit.

Control valves MV1 and MV2 are electrically driven, that is, —in the case of an electromagnetic drive—are opened and closed by energizing of a coil, for instance. Control valves MV1 and MV2 are also known as solenoid valves and may each have electrical output stages, so that the electrical control signals are able to have a low electrical power.

Working cylinder 3 takes the form of a differential cylinder having a piston 5 that has a larger upper effective area $A_{up}$ and a smaller lower effective area $A_{low}$. Upper effective area $A_{up}$ delimits a first working chamber 7, and lower effective area $A_{low}$ delimits a second working chamber 9 of working cylinder 3. Both working chambers 7 and 9 are provided with pressurized hydraulic fluid, e.g., hydraulic oil, by a supply line 11 made up of sections 11*a*, 11*b* and 11*c*. For this purpose, working cylinder 3 is hydraulically connected on the high-pressure side via supply line 11 and non-return valve NV1 to a high-pressure accumulator 13 which is fed by a high-pressure pump 17.

First control valve MV1 is disposed in section 11*b* of supply line 11, which connects second working chamber 9 and first working chamber 7. In the switching state depicted in FIG. 1, it is closed and de-energized.

The hydraulic fluid in first working chamber 7 is able to be carried away via a return line 19 which is made up of sections 19*a*, 19*b* and 19*c*, and which in section 19*c* is pressureless or acted upon by low static pressure. Second control valve MV2, which is shown open in FIG. 1, is disposed in return line 19. Second control valve MV2 is advantageously open at zero current.

In second working chamber 9, a closing spring 27 may be provided which, when working cylinder 3 is without pressure, brings gas-exchange valve 1 into the closed position, that is, in contact against valve seat 2, or retains it in this position.

Moreover, a further control valve MV3 (not shown in FIG. 1) may be provided with which, as described in German Patent Application No. DE 10 2004 022 447 A1, at the end of an opening operation, a low-pressure source is able to be switched in through which hydraulic fluid may be fed into first working chamber 7 during an inertial further movement of the actuator. An increase of the lift accompanied by reduced expenditure of energy is thus attainable; from the standpoint of control engineering, this lift increase may be treated as a partial lift described further below. In particular, the driving of control valve MV3 may be incorporated into the drive-correction method according to the present invention by, for example, correcting an opening duration of control valve MV3 on the basis of a feedback about the preceding movement characteristic during the opening of actuator 30 or gas-exchange valve 1.

Further embodiments of working cylinder 3 or of actuator 30 not indicated in detail here are possible and equally suitable for the practical application of the control method according to the present invention.

Between first working chamber 7 and second control valve MV2, a hydraulic braking element 29 is provided which optionally, may also be controllable. This hydraulic braking element 29 functions as follows: When piston 5 moves up, and consequently the volume of first working chamber 7 is reduced, the hydraulic fluid flows out of first working chamber 7 through section 19*a* of return line 19 until the top edge of piston 5 closes section 19*a* of return line 19. Thereupon, the hydraulic fluid is only able to flow off from first working chamber 7 via hydraulic braking element 29, which is made up of a throttle. Due to the braking element's resistance to flow, which is increased compared to section 19*a* of the return line, piston 5 is braked before gas-exchange valve 1 rests on valve seat 2.

Disposed in high-pressure accumulator 13 are a temperature sensor $T_{rail}$ and a pressure sensor $p_{rail}$, which are connected via signal lines to a control unit 31. High-pressure pump 17, as well as first control valve MV1 and second control valve MV2, as well as an optional third control valve MV3 (not shown in FIG. 1) are likewise connected via signal lines to control unit 31 and are driven by it. The signal lines are depicted as dashed lines in FIG. 1.

To open gas-exchange valve 1, initially second control valve MV2 is driven and thereby closed. Subsequently, first control valve MV1 is driven and therefore opened. In this manner, a pressure equalization takes place between first working chamber 7 and second working chamber 9. Consequently, gas-exchange valve 1 opens, because end face $A_{up}$ of piston 5 to which pressure is applied from first working chamber 7 is larger than annular surface $A_{low}$ of piston 5 to which pressure is applied from second working chamber 9.

To control the opening of gas-exchange valve 1 and especially the resulting valve lift, the driving of first control valve MV1 is therefore of great importance in two different respects: First of all, the beginning of the opening movement of gas-exchange valve 1 is determined by the beginning of the driving of first control valve MV1, and secondly, the duration of the driving—hereinafter known as driving duration tm1—has considerable influence on the lift of gas-exchange valve 1. Driving duration tm1 establishes how long first control valve MV1 remains open, from which is obtained the quantity of oil flowing from high-pressure accumulator 13 into first working chamber 7, which in turn directly determines the valve lift. As first control valve MV1 is thus closed again at the correct instant, the desired valve lift of gas-exchange valve 1 is obtained.

When gas-exchange valve 1 is to be closed again, the driving of second control valve MV2 is ended and the valve is thereby opened, so that pressure $p_{odr}$ in first working chamber 7 breaks down, and the hydraulic force exerted by second working chamber 9 on piston 5 closes gas-exchange valve 1.

Control unit 31 includes a data memory 33, a central processing unit (CPU) 34 and an input/output unit 35 which, for example, in addition to being responsible for processing the signals of a temperature sensor $T_{rail}$ and pressure sensor $p_{rail}$ indicated above, is responsible for processing a transducer signal for the angular position of a crankshaft (not shown) and/or the signal of a transducer 38 for detecting the positioning travel, i.e., the position of gas-exchange valve 1, and for generating suitable drive signals for control valves MV1 and MV2.

This exemplary organization of control unit 31 serves to introduce some of the more important components of the electronic system, which are used for the technical description of the present invention. In one possible embodiment, control unit 31 may be made up of a plurality of separate parts (not shown), which are connected by electrical lines or communication channels and, for example, may also be attached to individual actuators 30.

Various conventional designs are known for a transducer 38 for recording the positioning travel or the position, for example, sensors which supply a continuous (proportional) signal and, for instance, operate on the basis of electro-magnetic induction (like differential coil configurations), or sensors which detect the positions or position changes, e.g., with the aid of optical or magnetic sampling of a pattern stamped on the moving part, here the valve stem of gas-exchange valve 1, and indicate this information as signal edges or pulses, for example. Transducer 38 outputs a signal, corresponding to the positioning travel of the gas-exchange valve, at at least one location or at at least one instant of an opening movement. The positioning travel is the path covered by gas-exchange valve 1 during an opening or closing operation of said valve. It may be measured relatively from an arbitrary reference position or, for example, from the closed or completely open position of the gas-exchange valve.

Alternatively to a direct acquisition as indicated by way of example, the positioning travel or valve lift may also be determined from other measuring signals with the aid of models. For example, from the measurement of a differential pressure which represents a pressure drop across control valve MV1 during an opening operation of gas-exchange valve 1, it is possible to ascertain the flow rate of hydraulic oil via control valve MV1 into first working chamber 7, and from that, to ascertain the resulting lift of gas-exchange valve 1 with the aid of integration.

Figure 2A:
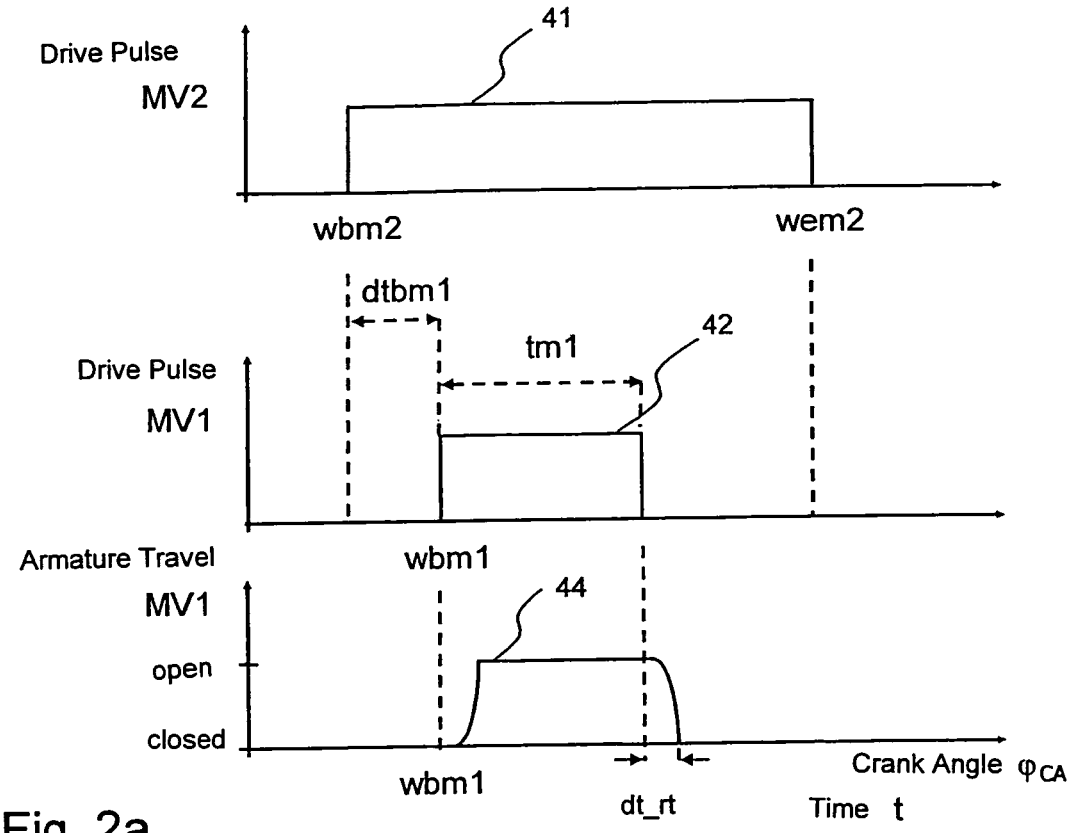
FIG. 2*a* shows an exemplary driving of control valves MV1 and MV2 in the case of a non-graduated opening characteristic of an EHVC actuator and a corresponding movement characteristic of the lift armature of control valve MV1.

FIG. 2*a* shows timing diagrams for the drive pulses of control valves MV1 and MV2 of an EHVC actuator; the typical case of a driving for a one-time opening of actuator 30 or gas-exchange valve 1 with non-graduated opening and closing movements is described.

Drive variable tm1, that is, the pulse length of the MV1 drive pulse, is primarily relevant for the present invention. This variable determines the opening duration of control valve MV1 which is readable on curve 44, the travel of the lift armature of control valve MV1. The armature travel is a measure for the flow cross-section. The quantity of hydraulic oil flowing from high-pressure accumulator 13 (FIG. 1) into the EHVC actuator or its working cylinder 3 is metered with the aid of duration tm1 of the driving and the opening duration of control valve MV1 thereby determined. From this is obtained the resulting valve lift 1.

Moreover, the beginning of drive pulse 42 of control valve MV1 is significant, which is denoted by a crankshaft angle wbm1. It determines the beginning of the movement of gas-exchange valve 1 upon opening. With the end of driving 42, the closing movement of the solenoid-valve armature, curve 44, is initiated. In this context, a delayed reaction, that is, a delay time up until the beginning of the return-travel movement of the armature, as well as a transition time for the transition itself must be observed. The sum of the times is denoted as return-travel time dt_rt, see FIG. 2*a*. In this time span, control valve MV1 is thus still open or not yet completely closed.

FIG. 2*a* also shows that drive pulse 41 of solenoid valve MV2 begins by a predefined time span dtbm1, in the typical case approximately 1 to 2 ms, prior to the driving 42 of control valve MV1. Delay time dtbm1 is applied and is suitably dimensioned so that control valve MV2, closing when being energized, is safely closed before control valve MV1 begins to open, which initiates the inflow of hydraulic oil to working cylinder 3 (see FIG. 1), and as a result, the opening operation of the actuator.

The present invention is not limited to the simplest case of the opening characteristic shown in FIG. 2*a*. For example, a repeated opening of first control valve MV1 or an additional opening of a third control valve MV3 may also be used to form the opening characteristic of the actuator or to open the actuator in partial lifts.

Figure 2B:
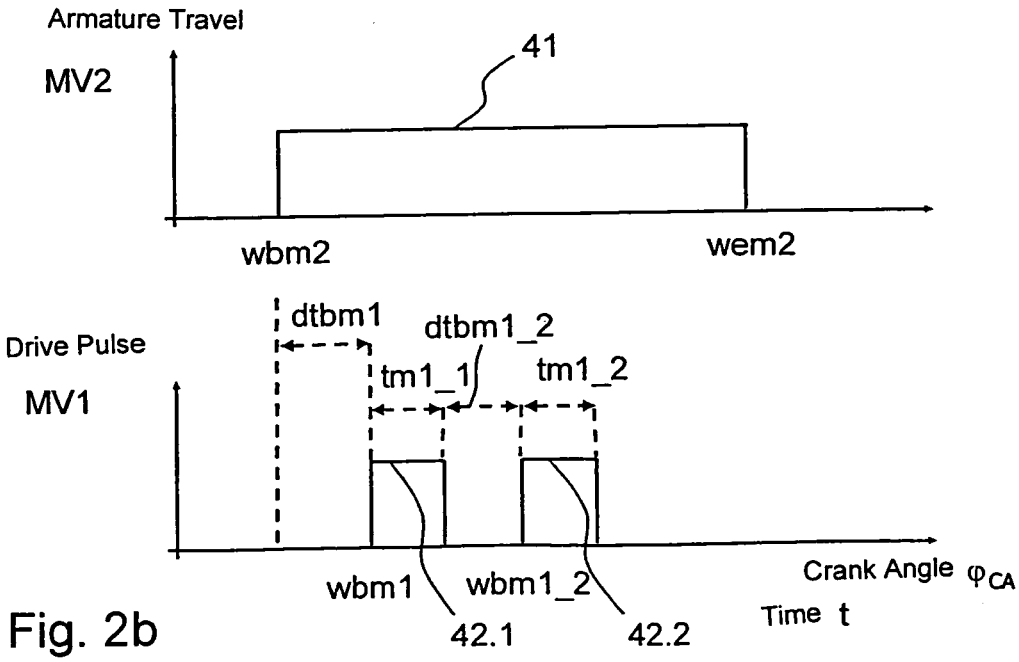
FIG. 2*b* shows a driving of control valves MV1 and MV2 of an EHVC actuator for an opening characteristic in two partial lifts.

FIG. 2*b* shows by way of example the drive pulses of control valves MV1 and MV2 for the case of the opening of an actuator 30 or gas-exchange valve 1 in the context of an opening characteristic graduated with the aid of two offset partial lifts. Driving 41 of control valve MV2 remains unchanged in comparison with FIG. 2*a*. On the other hand, the driving of control valve MV1 shows two individual pulses 42.1 and 42.2 having pulse durations tm1_1 and tm1_2, respectively, which determine the height of the first or second partial lift of gas-exchange valve 1. First pulse 42.1 again exhibits the already described time delay dtbm1 with respect to the beginning of MV2 pulse 41. In addition, a time difference dtbm1_2 occurs which defines the time interval between pulses 42.1 and 42.2. Alternatively, the beginning of second pulse 42.2 may also be established by an angle mark wbm1_2. The correlation of the time-based and angle-based description is given by the conversion tm1_1+dtbm1_2=(wbm1_2−wbm1)/neng, with engine speed neng.

Figure 3:
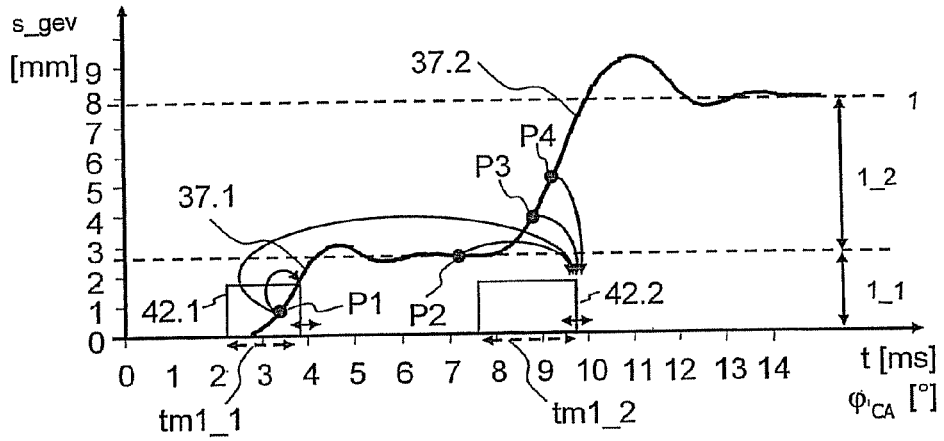
FIG. 3 shows an opening characteristic of a gas-exchange valve opened in two partial lifts by EHVC, as well as exemplary drive corrections of control valve MV1 according to the present invention.

The result of such a driving is sketched illustratively in FIG. 3 with the opening characteristic of a gas-exchange valve 1 formed by two partial lifts 37.1 and 37.2. The diagram also shows the two associated drive pulses 42.1 and 42.2 of first control valve MV1, having pulse durations tm1_1 and tm1_2.

Using a drive correction according to the present invention based on positioning travel, in the example of FIG. 3, at least one of the two pulse durations is corrected at least indirectly on the basis of an acquisition of the positioning travel. The acquisition of the positioning travel furnishes a feedback about the opening characteristic of gas-exchange valve 1 at at least one point; four such acquisition points are shown by way of example in FIG. 3, having the designations P1, P2, P3 and P4.

Starting from there, FIG. 3 shows the possibilities in principle of a drive correction according to the present invention in terms of the possible instants of effect, with reference to the arrows which start from points P1 to P4 and in each case are directed to the end of a drive pulse. It is shown illustratively that, on the basis of the acquisition of point P1 during the first partial lift, driving time tm_1 of this first partial lift is corrected once. Analogously, on the basis of points P3 and P4 during the second partial lift, driving duration tm1_2 for this second partial lift is corrected twice.

Moreover, the possibility is indicated that additionally or instead of a correction of first pulse duration tm1_1, the driving of a subsequent drive pulse, e.g., its pulse duration tm1_2 may also be corrected on the basis of feedback P1. In the same way, the last-named correction may also start from point P2, with which, illustratively, a resulting lift level l1_1 of the first partial lift is recorded.

In both last-named cases, according to the present invention, a correction for the second driving may also be carried out indirectly by the correction of a control setpoint for height l_2 of the second partial lift. In this manner, a deviation ascertained during or after a first partial lift may be compensated for in a further partial lift along the lines that a resulting lift l=l_1+l_2 is adjusted in the best possible manner in accordance with a control setpoint (l_setpoint). In the special case, such a further partial lift may also be produced by an auxiliary device indicated above, having a third control valve MV3, an opening time or control setpoint of this third control valve being corrected.

Figure 4:
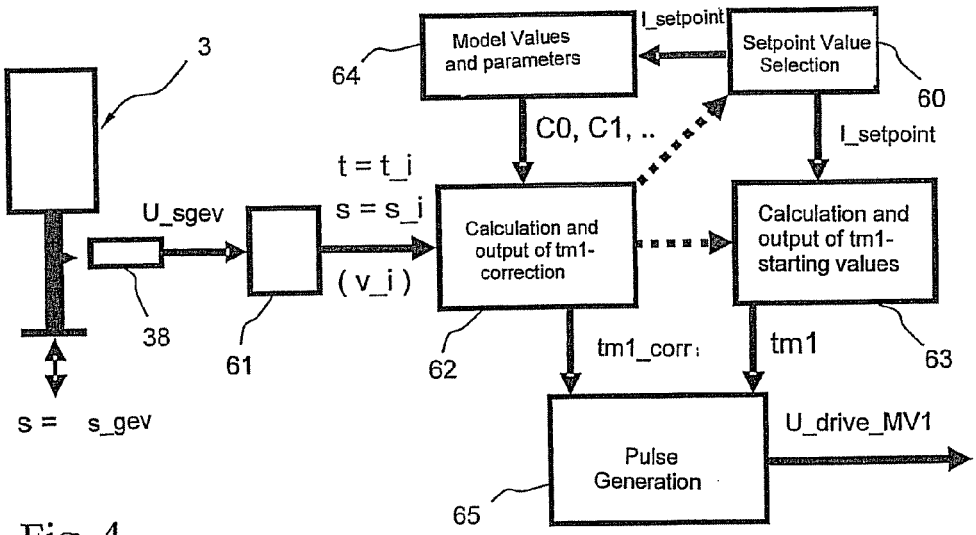
FIG. 4 shows a block diagram that illustrates an exemplary system for implementing a drive correction according to the present invention based on positioning travel.

FIG. 4 shows an exemplary setup for realizing methods according to the present invention for a drive correction based on positioning travel. An example embodiment of the present invention is described below based on this setup and the flowchart shown in the further FIG. 5.

The circuit diagram in FIG. 4 is divided into three levels, the lower level representing the generation of the drive signal, for which function module 65 is responsible. In this case, by way of example, a drive signal is generated for a control valve MV1 as pulse-shaped voltage characteristic U_drive_MV1. In addition, the generating of a drive signal U_drive_MV3 for a control valve MV3 indicated further above may also be contemplated and incorporated into the method of the present invention.

The desired pulse duration is ascertained in the middle level by modules 63 (starting value tm1) and 62 (correction value tm1_corr), respectively, and passed to pulse-generating unit 65. In this context, the correction value is able to overwrite the starting value or an earlier correction value during ongoing pulse generation. Analogously, a setpoint value for the pulse beginning is also determined in the middle level and passed to module 65 (not shown in FIG. 4).

Module 63 corresponds to conventional control functions for the lift of an EHVC actuator. It converts a suitable setpoint value l_setpoint into driving time tm1 as a function of the operating point. Further module 62 expands this related art in accordance with the present invention, by correcting the driving time on the basis of at least one pair of values (t_i, s_i) which characterizes one point of the movement characteristic, that is, one position, assigned to one instant t_i, on positioning travel s_gev(t) upon the opening of actuator 30.

The pair of values (t_i, s_i) as well as possibly further movement variables, e.g., a velocity v_i at instant t_i, is generated by function module 61, which acquires and conditions a signal U_sgev, for example, a signal voltage, from transducer 38.

Central function module 62 according to the present invention receives from the upper level, auxiliary variables, e.g., model values and parameters calculated in advance, among which may also be control setpoint l_setpoint or information equivalent thereto.

Figure 5:
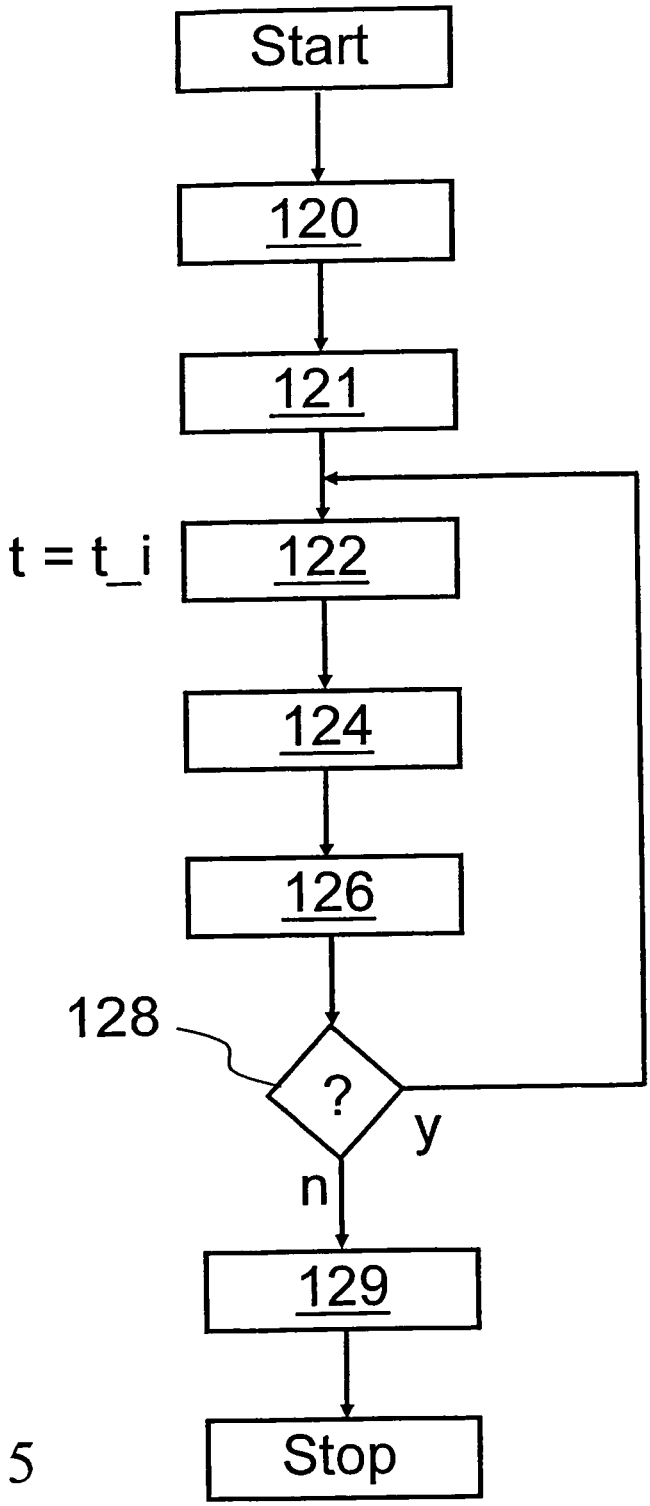
FIG. 5 shows a flowchart that represents the essential method steps of drive methods according to the present invention by way of example.

The flowchart in FIG. 5 represents illustratively example method steps of control methods according to the present invention, with driving-time correction on the basis of a positioning-travel feedback. These steps are clarified in greater detail below with reference to the function block diagram in FIG. 4.

After the start of the sequence of operations shown in FIG. 5, in a first step 120, instantaneous values of operating-point-specific influence variables of the positioning operation of hydraulic actuator 30 to be controlled, e.g., an oil pressure poil and an oil temperature Toil, are first of all ascertained, if necessary. These values enter into the calculation of model values or parameters C0, C1, . . . and of a starting value tm1 of the driving duration of control valve MV1 likewise performed in step 120. In the exemplary device according to FIG. 4, these calculations, which are also described further below in greater detail for various exemplary embodiments, are performed by function modules 63 and 64. At the same time, in particular the given lift setpoint value l_setpoint—possibly also several setpoint values in the case of an opening in partial lifts—is also entered. At the end of step 120, parameters C0, C1, . . . are passed to function module 62, and starting value tm1 is passed to functional unit 65 responsible for generating the drive signal.

In step 121 of the flowchart in FIG. 5, at the desired instant, pulse-generating unit 65 begins to output the relevant drive signal by which, for example, a control valve MV1 is driven. At the same time or delayed in time, the acquisition—for which module 61 is responsible—and possibly conditioning of a signal U_sgev generated by sensor 38 and characterizing positioning travel S=s_gev of actuator 30 or gas-exchange valve 1 is started (provided this acquisition is not carried out continuously). Moreover, the starting time of pulse generation t_start is stored, a task taken on here by module 62 as example.

In the following step 122 according to FIG. 5, one point (t_i, s_i), where s_i=s_gev(t_i), of the travel-time characteristic of the positioning movement is recorded at least indirectly, for which submodule 61 from FIG. 4 is responsible. In this context, instant t_1 may either be an instant established in advance—relative to the beginning t_start of the driving—at which the lift characteristic s_gev(t) is sampled, or the instant is defined by a suitable trigger event of input signal U_sgev, such as a signal edge of a pulse-generator or incremental-encoder signal, and is recorded, for example, with the aid of a timer or capture register. In the last case, position s_i of actuator 30 or of gas-exchange valve 1 corresponding to the event is known in advance at least as a relative value (with regard to a reference position). In principle, both values t_i, s_i may also be measured.

The information thus obtained about the characteristic of the positioning movement of hydraulic actuator 30 driven according to the present invention is transmitted to function module 62, which subsequently further processes it immediately.

This is accomplished in following step 124 of the flowchart where, for example, module 62 determines whether a recorded instant t_i or a position s_i, or a further movement variable ascertained therefrom like, for example, a present or average velocity, deviates from an anticipated value, and whether the driving should be corrected accordingly. Alternatively, it may also be provided that, in principle, the drive variable, here pulse duration tm1, is redetermined or corrected on the basis of instantaneously obtained information about the characteristic of the positioning movement.

If module 62 is designed to carry out the indicated check or to determine a relevant deviation, then the anticipated value of an instant or of a movement variable is preferably calculated in advance in step 120 and made available as one of parameters C0, C1, . . . .

At the same time, it is advantageous if, on the basis of the magnitude of a determined deviation, module 62 assesses whether a fault of actuator 30 or of control system 31 exists which requires special protective measures, or even prohibits further operation of actuator 30. In such a case, module 62 reports the existence of the fault condition and/or brings about suitable measures such as the termination of the driving or an activation of shut-off paths of the control system.

If in step 124 it is ascertained or in principle is provided that drive variable tm1 should be redetermined, then immediately following, method step 126 according to FIG. 5 is carried out in which function module 62 performs the suitable corrective calculation and passes the newly ascertained or corrected value tm1_corr to module 65. On the other hand, if a correction of the ongoing pulse output, that is, of the end of the pulse output determined by drive variable tm1, is no longer possible in time, for example, or should not be carried out for another reason, then alternatively, e.g., given an opening characteristic in partial lifts, correction information may be made available for a following drive pulse, for example, in the form of a correction value for a further driving of control valve MV1 or of a control valve MV3, as described above. For instance, the correction value may be indicated for a driving duration or opening duration of the control valve in question, or for a suitable control setpoint, e.g., the height of a partial lift.

At the following branching point 128 of the flowchart in FIG. 5, it is determined whether further "samplings" (t_i, s_i) of the positioning movement or further corrections of the driving should be carried out, provided the pulse generation is still running. If necessary, the program branches back to step 122, and the sequence of steps 122 through 128 is repeated. In the other case, the method is ended after running through step 129, in which yet another evaluation or utilization of the information obtained about the positioning movement, e.g., in the form of an adaptation of model parameters, may be provided.

Starting from this general description of the method according to the present invention, in the following, first of all two simple exemplary embodiments of the present invention are presented, in which in each instance a one-time correction of a driving duration tm1 is carried out. Subsequently, an iterative method variant is described, in which variable tm1_corr is continually redetermined.

For the two simple examples, it is assumed that a point of the opening characteristic of a gas-exchange valve 1 to be controlled according to the present invention is recorded or determined as pair of values (t_i, s_i), where i=1, and that from that, a corrected driving duration tm1_corr is directly ascertained and passed to pulse-generating unit 65. In these examples, a model of the movement characteristic is needed, which enters both into the calculation of starting value tm1 and of correction value tm1_corr. Specifically, mutually consistent models are needed for the positioning travel $$s_gev=s_gev(t-t_\mathrm{start};poil,Toil,fgas,\ldots) \quad \text{(M1)}$$

as function of time and of the influence variables (such as oil pressure poil, oil temperature Toil, gas force fgas and possibly others) as well as for the drive-variable transfer function $$tm1_=tm1(l_\mathrm{setpoint};poil,Toil,fgas,\ldots). \quad \text{(M2)}$$

t_start is the beginning instant of a positioning operation, l_setpoint is a control setpoint of the lift. This may also be a lift increment when an actuator 30 or gas-exchange valve 1 is intended to be opened in a plurality of partial lifts. In a second exemplary embodiment, the inverse function of function s_gev( ) is also used:

$$t-t_\mathrm{start}=s_gev_inv(s;poil,Toil,fgas,\ldots) \quad \text{(M3)}$$

Suitable representations of these functions are described in German Patent Applications DE 10 2005 002 385 A1 and DE 10 2005 002 384 A1 for the lift control of the EHVC actuator. Incidentally, the iterative method explained further below makes do without such a model.

In the first simple exemplary embodiment, the starting point is a recording of a position s_i=s_gev on the positioning travel of a gas-exchange valve 1 at a given and suitably selected sampling instant t_i during the opening movement of gas-exchange valve 1. For example, this is possible on the basis of a travel-proportional sensor signal (transducer 38). For the time-critical corrective calculation of module 62, whose result tm1_corr should be available at pulse-generating unit 65 as immediately as possible after recording instant t_i, model values C0 and C1 are already determined in advance and made available.

In this case, an anticipated positioning travel s_i_setpoint which, according to movement model (M1), should be present at sampling instant t_i, that is, after a time duration t_i−t_start as of the start of driving of control valve MV1 is determined as model variable C0:

$$C0=s_i_\text{setpoint} \quad (1)$$

Further parameter C1 is ascertained as inverse value $$C1=1/v_gev_e \quad (2)$$

of velocity v_gev_e, which according to the movement model, is anticipated at the shut-off instant for the driving of MV1. In this context, the shut-off instant is assumed in accordance with the starting value of pulse duration tm1, which likewise is determined from the movement model or the drive-variable transfer function (M2) consistent with it.

A deviation of recorded value s_i from anticipated value C0=s_i_setpoint expresses a need for a correction of the driving, which in the simplest and already quite good approximation, is representable as follows:

$$tm1_\text{corr}=tm1_+C1*(C0-s_i) \quad (3)$$

With this very simple calculation, in this example, the necessary correction value of the driving duration is determined and output by module 62. An improved correction may be attained in that, from the determined deviation, or from a number of such determined deviations in the event the movement characteristic is sampled repeatedly, in a first step, a correction or adaptation of movement model (M1) is obtained, and in a second step, a drive correction is determined with the aid of consistently improved model (M2) and is output.

In a second simple exemplary embodiment of the present invention, the starting point is the recording of an instant t_i at which gas-exchange valve 1 reaches a known position s_i during an opening movement, that is, s_gev=s_i. For example, this is representable on the basis of a position transducer 38 which indicates by a pulse or a signal edge that the gas-exchange valve has reached position s_i.

Parameters C0 and C1 are ascertained in advance in this exemplary embodiment as well, and are made available for the later time-critical corrective calculation. C0 is determined as instant t_i_setpoint, relative to the beginning t_start of the driving, at which position s_i is expected to be reached according to movement model (M3):

$$C0=t_i_\text{setpoint}-t_\text{start} \quad (4)$$

Model (M2) consistent with that is in turn used for the calculation of the tm1-starting value, which is carried out by module 63, FIG. 4. Already with the simple correlation $$C1=1 \quad (5)$$

of parameter C1, a usable correction of the driving is determinable along the lines of an at least partial compensation of an ascertained time error $$(t_i-t_\text{start}-C0):$$

$$tm1_\text{corr}=\text{tm1}+C1*(t_i-t_\text{start}-C0) \quad (6)$$

A better correction is obtained by likewise taking into account a velocity error going along with the time error or, as mentioned in the first example, determining an adaptation of model (M1) which enters into the corrective calculation according to the present invention in this example.

With the first as with the second exemplary embodiment of the present invention, a considerable decrease of positioning errors of the lift of a hydraulic gas-exchange valve 1 is already achieved on the basis of the positioning-travel feedback at a single point. With an expansion to two or three recorded points (t_i, s_i), in both embodiments described, a highly accurate lift control is able to be represented which also tolerates great fluctuations or errors of influence variables like, for example, oil pressure poil or a gas force fgas.

Finally, a correction step according to the present invention may also be carried out iteratively and in possibly rapid succession on the basis of a continually acquired feedback about the opening characteristic of actuator 30. This has the advantage that the necessary shut-off point first has to be determined by the correction values with high accuracy upon approaching the ideal instant, which algorithmically, allows very simple, signal-based evaluation and correction methods that can be realized well by hardware (e.g., ASIC). In this context, a simple model calculation is needed only for the prediction of the further movement in the "after-run phase" after the driving has ended. In the following, a third exemplary embodiment of the present invention is described which illustrates these method variants.

Figure 6:
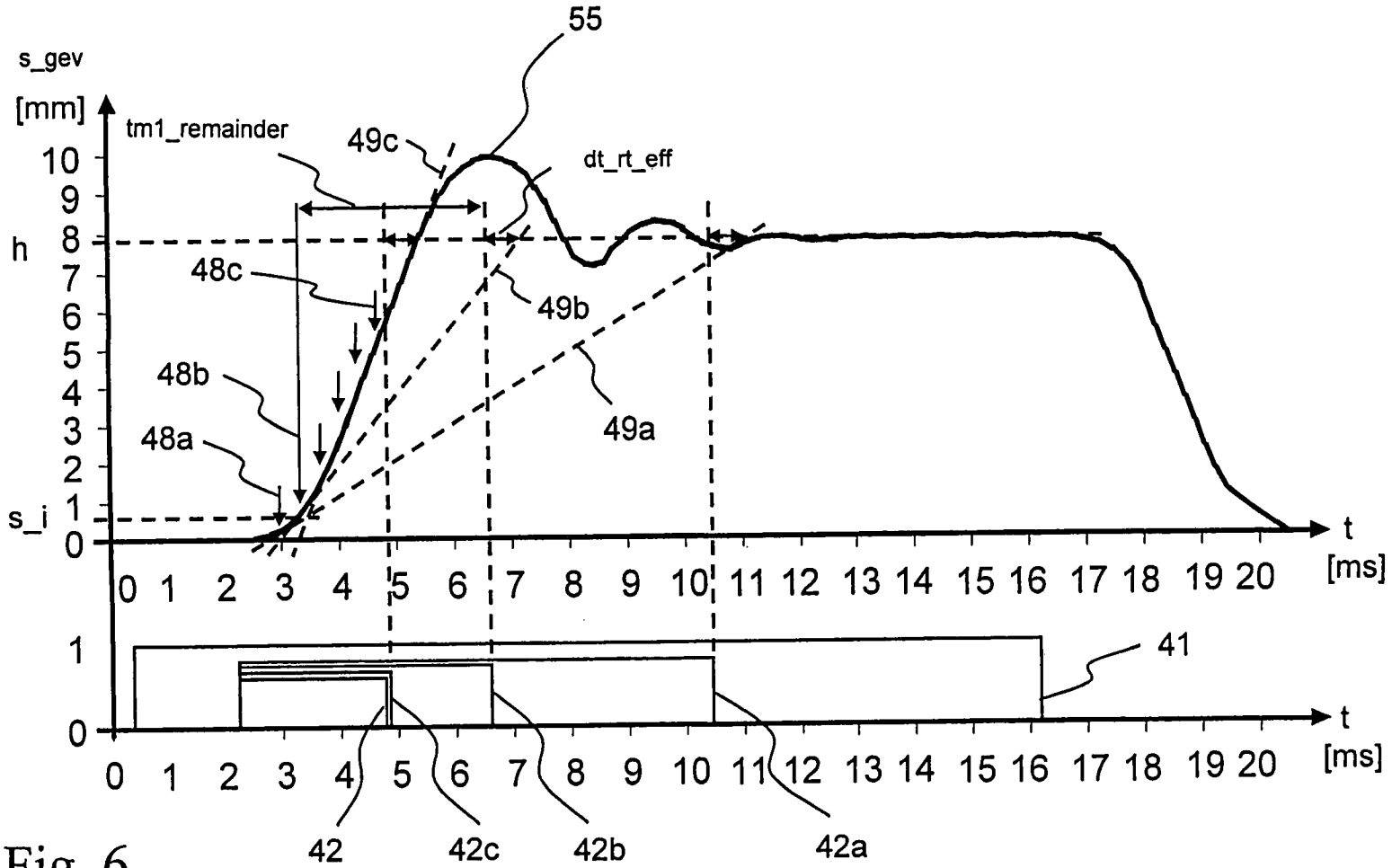
FIG. 6 shows a diagram that illustrates a method of the present invention having iterative drive correction of control valve MV1, using the opening characteristic of a gas-exchange valve adjusted by EHVC as example.

The curve diagram in FIG. 6 illustrates such a method according to the present invention, having iterative correction of the opening time or driving duration of control valve MV1 on the basis of an exemplary movement characteristic 55 of a gas-exchange valve 1 adjusted by EHVC. Associated drive pulses 42 of first control valve MV1 and 41 of second control valve MV2 are likewise shown.

In the iterative correction of pulse duration tm1 shown in FIG. 6, the driving time of control valve MV1 needed for a desired valve lift 1=l_setpoint is approached stepwise. This is signified with the illustratively represented approximations of drive pulse 42 by pulses 42*a*, 42*b* and 42*c*, which belong to selected instants or sampling points of the opening characteristic of curve 55, that are indicated by arrows 48*a*, 48*b* and 48*c*. In this context, the pulse length of the MV1-driving is altered successively during the already ongoing pulse output and opening movement of gas-exchange valve 1, in the present case is shortened, which is typical or characteristic for this variant of the general method of the present invention.

The principle of this exemplary implementation of an iterative, signal-based driving-time correction is based first of all on determining at a sampling point t_i, e.g., 48*a*, the presently covered travel s_i of the gas-exchange valve, as well as its instantaneous velocity v_i from the sensor signal of positioning-travel transducer 38, FIG. 1. Starting from there, the assumption that gas-exchange valve 1 will not accelerate any more during the further opening leads to a hypothetical further opening characteristic as indicated by the broken straight lines 49*a*, 49*b* and 49*c* in association with the indicated sampling points. In each instance, from this is derived an estimate of necessary pulse duration tm1 or of remaining pulse duration tm1_remain of the already ongoing pulse output, this remaining duration being indicated by way of example for sampling point 48*b* and extrapolated, uniform movement line 49*b*. This time tm1_remain, from which the estimated pulse length of approximation 42*b* directly follows, is yielded from the instant at which line 49*b* reaches desired valve lift 1, shortened by a time span dt_rt_eff, which takes into account the return-travel time of the MV1 armature, see curve 44 in FIG. 2*a*, and therefore the lift increase after control valve MV1 is de-energized. The reason return-travel time dt_rt (see FIG. 2*a*) itself is not added here is as follows: During the return movement of the solenoid-valve armature, the oil flowing via control valve MV1 is throttled, so that the assumption of a lift increase that corresponds to a constant oil flow during time dt_rt is not correct, but rather somewhat overestimates the lift increase. This effect is taken into consideration by an effective return-travel time, suitably shortened with respect to dt_rt, in the indicated calculation of remaining time tm1_remain.

Therefore, the continuous calculation of a pulse-length approximation tm1 or remaining duration tm1_remain is obtained for the illustratively discussed case as follows:

$$tm1_remain=(l_setpoint-s_i)/v_i-dt_rt_eff \quad (7)$$

with the measured values or estimated values for valve travel s_i and velocity v_i determined instantaneously by signal analysis.

In the typical application case, effective return-travel time dt_rt_eff may be specified as a function of the oil-condition variables pressure poil and temperature Toil, as well as velocity v_gev_e existing at the instant of shut-off. For example, an instantaneous measured value $p_{rail}$ may be used for pressure poil, and a measured value $T_{rail}$ may be used for the temperature, see FIG. 1. Instead of or in addition to the temperature, the oil viscosity may also be included as an influence variable. The dependency on velocity v_gev_e may be described linearly with sufficient approximation, which leads to the representation $$dt_rt_eff=C0(poil,Toil)+C1(poil,Toil)*v_gev_e \quad (8)$$

with coefficient functions C0, C1 which, for example, are realized as program maps in electronic control unit 31 and, with respect to the program-map data stored for this purpose, are determined on the basis of measurements. Variable v_gev_e in turn may be approximated successively by values v_i, where i=1, 2, . . . .

As indicated in FIG. 6 with the difference between ideal drive pulse 42 and the last lift-determining approximation 42*c*, in the method of the iterative driving-time correction, a residual error of the adjusted valve lift will occur, whose magnitude is a function of the estimate error of velocity v_gev which was ascertained at the last sampling point and which here is used by way of example as estimated value of the average velocity for the further movement of gas-exchange valve 1 after the last sampling point. The quality of this approximation is a function of instantaneous acceleration a_gev and sampling increment dt_samp, as well as effective return-travel time dt_rt_eff. Naturally, it may be improved by a more costly (model-based) estimation method. As example, when working with time-synchronous sampling, variable dt_samp is the time interval between successive samplings, thus, in FIG. 3, the time interval between points 48*a* and 48*b*, and therefore between recalculations 42*a* and 42*b* of pulse durations tm1.

In the case of a maximum acceleration a_max, the corresponding lift error is limited by a_max*dt_samp*(dt_samp+dt_rt_eff). With typical values of a_max=2.5 m/s/ms and dt_rt_eff=0.5 ms, as well as a desired limit of the corresponding lift error of 0.05 mm, a sampling increment of approximately dt_samp=0.04 ms is obtained. In representing the signal-processing method with the aid of a digital signal processor (DSP), this demand is already able to be fulfilled. Costlier and improved signal-processing algorithms than stated here by way of example are also able to be realized in this way. Many present and future microcontrollers do and will offer such a DSP-core on-chip, and therefore provide the hardware requirements for a cost-effective realization of the method. In implementations with the aid of hardware (e.g., ASIC), even faster samplings or cycle times of the method are able to be shown.

In one advantageous further refinement, for example, the third exemplary embodiment may also be developed with the aid of an improved estimate or prediction of the further movement of gas-exchange valve 1, that is, of a lift error resulting in response to a presently existing driving, in such a way that even larger time steps of the recalculation of tm1 are permitted, and therefore a—possibly interrupt-supported—execution of the method may be carried out on the CPU of a microcontroller used in control unit 31. For a lift range from approximately 1 mm, this is possible without difficulty in any case, since the acceleration has then already subsided to small values. The error of the linear approximation for the further movement is negligibly small in the case of a larger lift, that is, after reaching the steady movement, as can be seen in FIG. 6.

On the other hand, further error influences on the resulting valve lift come about from measuring errors and estimation errors both for s_gev and v_gev, as well as from model errors of the model for dt_rt_eff. In particular, manufacturing tolerances of identical actuators can manifest themselves in such lift errors when, as is practical, the data, e.g., program-map data, with respect to equation (8) is determined and used uniformly for all identical actuators. Therefore, it presents itself to introduce and to develop individually for each valve, an expansion for the compensation of remaining systematic lift errors as, for example, are easily determinable with the aid of suitable averaging during steady-state operation. One simple and effective possibility is an augmentation of formula (8) for dt_rt_eff by a valve-individual adaptation value C0_adap. In so doing, the technical method for updating value C0_adap may be developed as a rather slow adaptation that proceeds over many successive positioning cycles or positioning operations of actuator (30), or also as a rapid cycle-to-cycle closed-loop control that is superimposed on the open-loop control according to the present invention.

Figure 7:
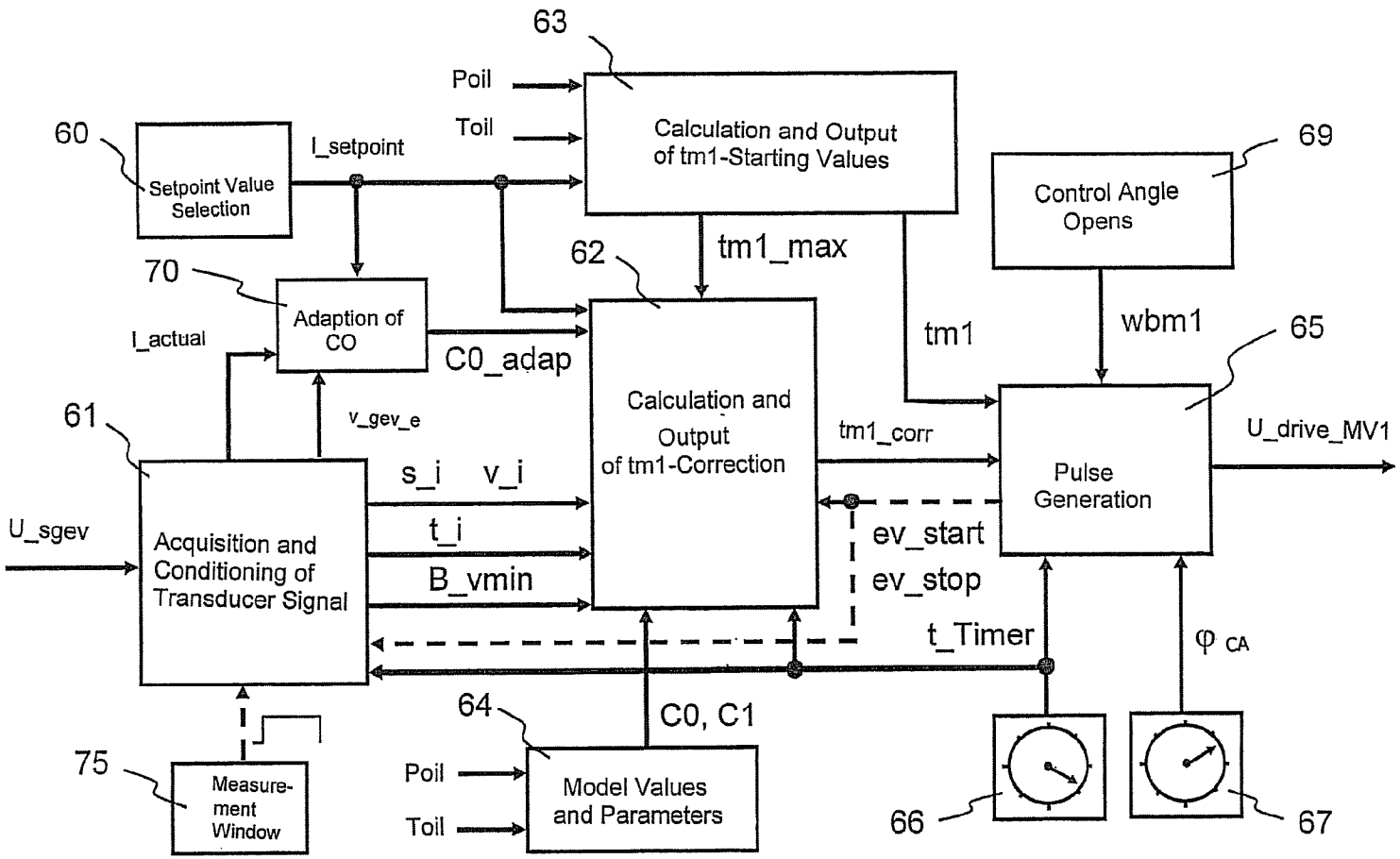
FIG. 7 shows a block diagram that describes an exemplary realization of this iterative drive correction.

FIG. 7 shows a block diagram that depicts an exemplary embodiment of the signal-based, iterative correction method (third exemplary embodiment) according to the method principle illustrated in FIG. 6. In this context, modules which are shown in FIG. 7 and FIG. 4 and have the same reference numerals correspond.

Thus, the already familiar function module 60 which, by way of example, provides a control setpoint l_setpoint of valve lift 1 of a gas-exchange valve 1 driven by EHVC, appears again in FIG. 7. In the event of an opening in partial lifts, analogously, several such setpoint values may also occur. In general, setpoint value l_setpoint is determined as a function of the instantaneous operating point of the combustion engine, thus, for example, as a function of engine speed neng and the power output desired by the driver. Setpoint value l_setpoint is fed into module 63 which calculates a starting value tm1 as well as, in this case, also a limitation tm1_max for the method of an iterative signal-based correction of the driving duration explained here by way of example.

Starting value tm1 is transmitted to unit 65 for the pulse generation, which generates the drive pulse for control valve MV1 and outputs it as electrical voltage characteristic U_drive_MV1. As example, unit 65 additionally receives an angle setpoint wbm1 for the beginning of the MV1 pulse. Alternatively, time span dtbm1—see, for example, FIG. 2*a*—may also be predefined with regard to the beginning of the associated MV2 drive pulse.

In the selected exemplary implementation, module 65 begins with the output of the drive pulse at the moment when crank angle $\phi_{CA}$ supplied from a unit 67 for the angle preparation reaches setpoint value wbm1. The pulse length is measured by timer 66 and, as said, is initially preset to a starting value tm1.

The beginning of the pulse output is indicated by a trigger event ev_start, which sets in motion the acquisition and signal processing in module 61 as well as the determination of a tm1-correction according to the present invention in module 62.

In one exemplary implementation, module 61 samples a travel-sensor signal, here, by way of example, a voltage characteristic U_sgev, and from that, determines instantaneous travel s_gev of gas-exchange valve 1 as well as its velocity v_gev as values s_i and v_i, which are assigned to respective sampling instant t_i. These values are in each case transmitted instantaneously or in a suitably selected time frame to central module 62. In this context, instant t_i is indicated with reference to clock 66, i.e., t_Timer. In an alternative implementation, for example, it may also be determined relative to the beginning of a driving of control valve MV1. An additionally transferred piece of logic information B_vmin indicates whether the beginning of the opening movement of gas-exchange valve 1 was detected, or whether a minimum velocity v_min is being exceeded.

In addition to this task, within the framework of the driving-time correction according to the present invention, module 61 is also responsible here for the sensor diagnosis, that is, for determining the plausibility of the signal and for suppressing interferences, as well as, optionally, for a calibration at regular intervals, for which dedicated measuring phases are provided in the present example. They are indicated to signal-processing module 61 by a measurement window output by a module 75 responsible for the sequencing control of calibration measurements.

Central module 62 is responsible for calculating updated, improved values tm1_corr of pulse duration tm1 and for their output to pulse-generating unit 65. This is accomplished here during the ongoing pulse output.

In addition to the continuously, instantaneously provided information t_i, s_i and v_i from module 61, module 62 also uses the output variables—calculated one time in advance—tm1_max from module 63 and C0, C1 from module 64 which provides the model values for effective return-travel time dt_rt_eff according to formula (8), as well as C0_adap from adaptation module 70.

As example, the last-named variable represents an adaptive, valve-individual correction of parameter C0, which module 70 determines on the basis of one or more preceding positioning operations. This calculation is based on the values for actual lift l_act measured or calculated for each positioning operation, associated setpoint lift l_setpoint, and associated final value v_gev_e of opening velocity v_gev, which was used in module 62 in the respective last correction step of the iterative driving-time correction. In the example of FIG. 7, value v_gev_e is determined by module 61 at the instant of trigger signal ev_stop and subsequently passed to module 70. Alternatively, it may also be determined and output by module 62.

Trigger signal ev_stop, generated by pulse-generating unit 65, indicates the end of the pulse output. At the same time, it also terminates the iterative repetition of the calculation and output operations of module 62.

In the further figures, exemplary realizations of the modules from FIG. 7 are specified with the aid of block diagrams.

Figure 8:
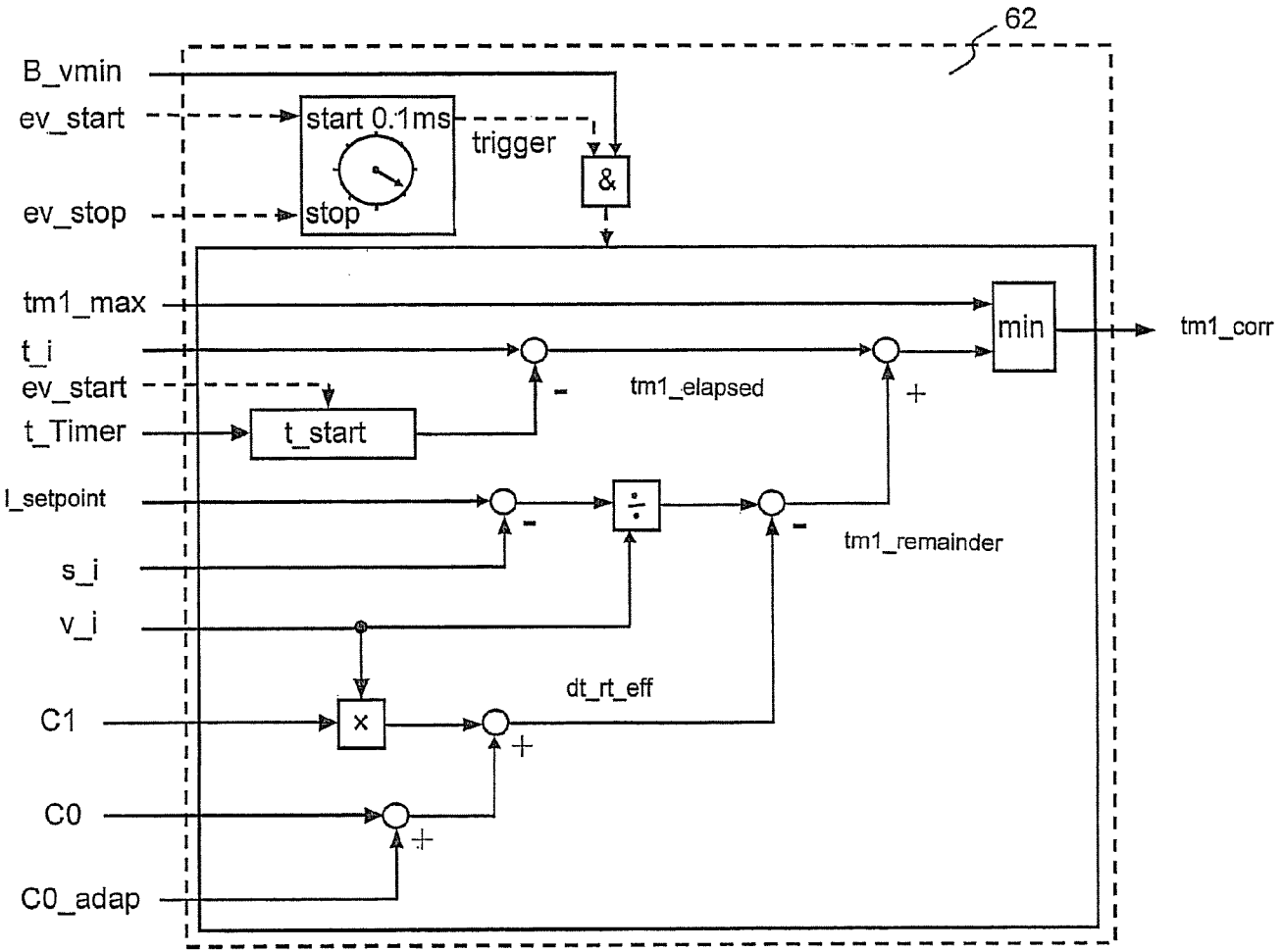
FIG. 8 shows a block diagram that describes an implementation of block 62 (calculation and output of a correction value tm1_corr).

The block diagram in FIG. 8 represents an exemplary realization of central calculation module 62. The time-controlled execution is indicated by way of example in a 0.1 ms frame in the upper part of the block diagram, the beginning and end being set by external trigger signals ev_start and ev_stop, respectively. In addition, condition B_vmin is taken into account, see above. Illustratively, the execution is carried out here in the same time frame as in module 61. However, the time frames may also be different.

The calculation part executed at a time includes, first of all, the determination of pulse duration tm1_elapsed already elapsed at an instant t_i, as well as the calculation according to the present invention of remaining time tm1_remain. The sum tm1_corr=tm1_elapsed+tm1_remain is passed, after limitation by tm1_max, to pulse-generating unit 65. Optionally, this limitation may also be omitted, since the calculations are only carried out in the case of v_i>v_min, which means correction value tm1_corr is already limited upwardly in any case. Driving time tm1_elapsed which has already elapsed is yielded from instantaneous time t_i and the beginning time, that is, timer status t_Timer upon start event ev_start which is saved in memory location t_start. The remaining time is calculated according to formula (7), dt_rt_eff also including the additive correction of C0 by adaptation value C0_adap.

At this point, it should be noted that as an alternative to tm1_corr, for example, tm1_remain may also be passed to output unit 65 if this appears more suitable. In general, the modularization including the interfaces used in FIG. 8 may also be configured differently than indicated by way of example. Thus, for example, instead of the variable v_i, it may also be useful to transfer its inverse value to module 62, and in this way to avoid a division from occurring in the calculations of module 62.

Figure 9:
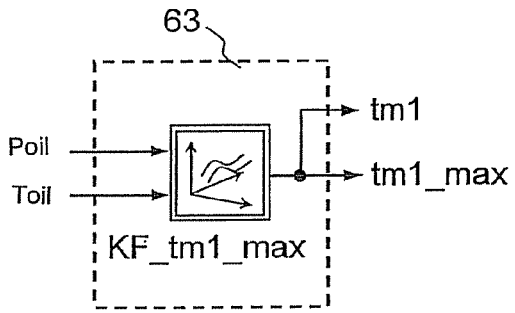
FIG. 9 shows a block diagram that describes an implementation of block 63 (calculation and output of a starting value tm1 as well as a tm1-limitation).

FIG. 9 shows a very simple calculation of limitation tm1_max with the aid of a program map, this value being used at the same time as starting value tm1.

Figure 10:
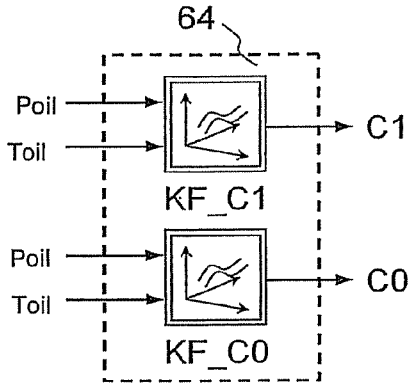
FIG. 10 shows a block diagram that describes an implementation of block 64 (calculation of model values).

In FIG. 10, coefficients C0 and C1 of equation (8) for time parameter dt_rt_eff are likewise determined from program maps depending on poil and Toil.

Figure 11:
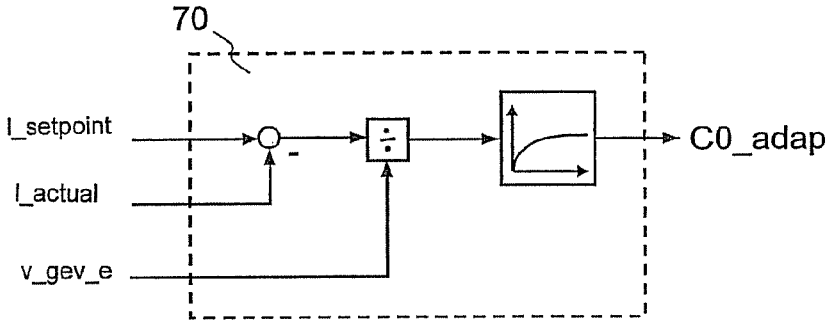
FIG. 11 shows a block diagram that describes an implementation of block 70 (adaptation of parameter C0).

FIG. 11 shows exemplarily a very simple realization of an adaptation or cycle-to-cycle control on the basis of parameter C0_adap. In this case, the lift error is converted using division by v_gev_e into a driving-time error which, after being low-pass-filtered, yields correction value C0_adap.

Figure 12:
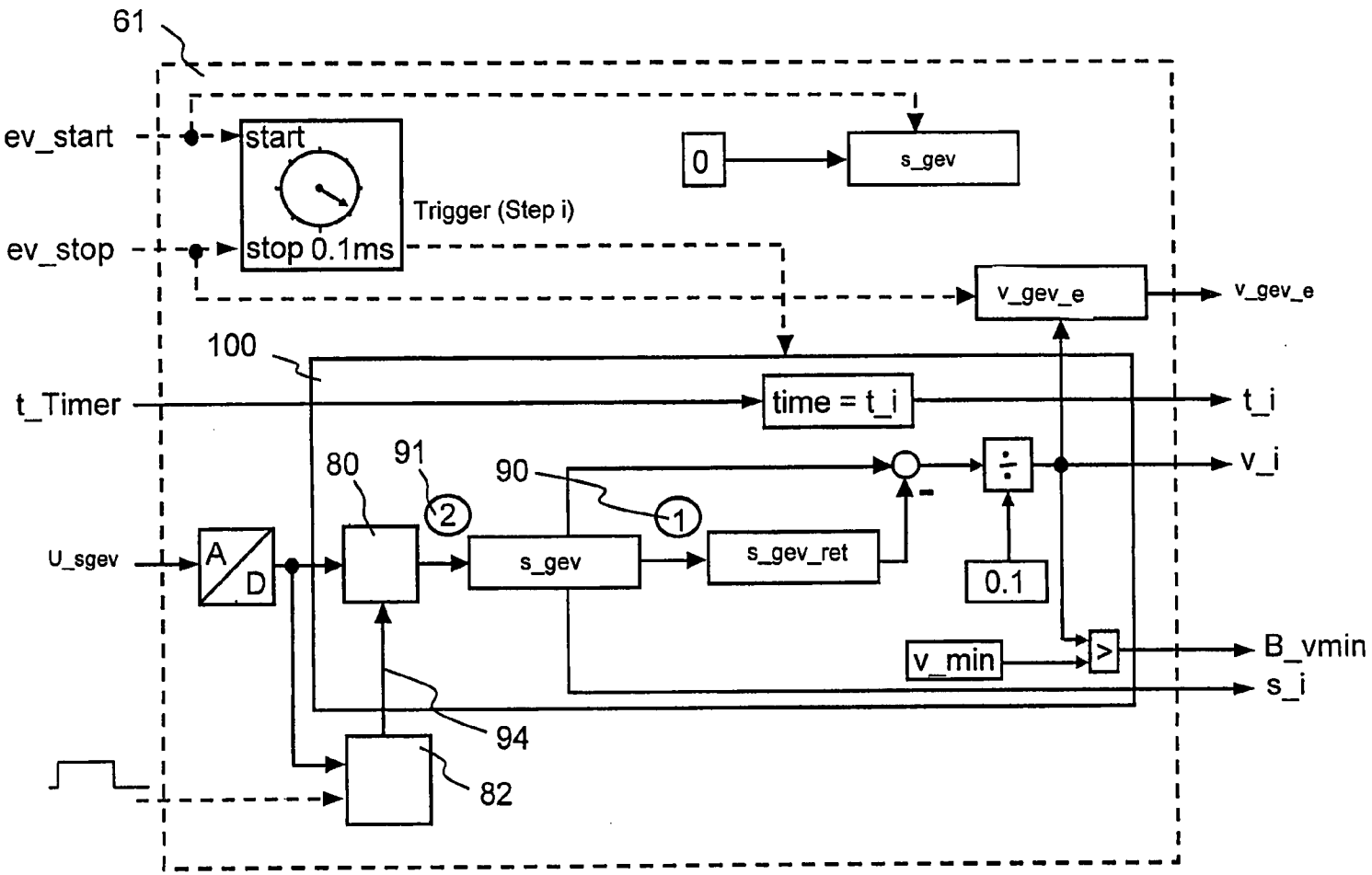
FIG. 12 shows a block diagram that describes an implementation of block 61 (acquisition and conditioning of a signal voltage U_sgev).

Finally, FIG. 12 shows an exemplary implementation of module 61, which here is responsible for the acquisition and conditioning of signal voltage U_sgev of a travel sensor. Downstream of an analog-to-digital converter, the digital raw value is further processed by a function module 80 which assumes various tasks of the signal processing and the diagnosis as are conventional in typical such cases. For example, the signal processing includes a linearization, an offset correction and/or scale correction and a filtering. As example, the diagnosis includes the recognition of short circuits and line break, as well as implausible values; if applicable, a temporary replacement value is also formed.

Calibration values, e.g., for offset correction and scale correction, are transferred from a module 82 via an interface 94 to module 80. Module 83 is responsible for performing calibration measurements, that is, the sampling and conditioning of measuring voltage U_sgev during the measurement windows predefined by unit 75 in FIG. 4. In this context, for example, the sensor calibration may start out from defined limit stops or end positions of the gas-exchange valve, such as the zero lift when the gas-exchange valve is closed and a known maximum lift determined by a mechanical limit stop. In the calibration measurement, the signal values are learned and converted into the correction variables; for example, in the case of zero lift, the signal voltage is converted into an offset correction, and in the case of maximum lift, the signal is converted into a scale correction. The zero lift may be learned at regular intervals between the opening operations of a gas-exchange valve 1. For the learning of the maximum limit stop, at greater time intervals or in special operating states such as overrun, for example, a special test mode may be switched in in which individual valves are moved slowly to the limit stop and the signal voltages are measured.

An output value s_i of module 80 with respect to a sampling step (i) is stored temporarily in a memory location s_gev after the last value, i.e., the position of the gas-exchange valve in the case of the last sampling step (i-1), has been relocated from this memory location to a memory location s_gev_ret. This sequence of operations is indicated by sequence numbers 1 and 2—reference numerals 90 and 91, respectively.

By way of example, velocity v_i is subsequently determined from the difference s_gev−sgev ret with the aid of division by the sampling increment, here 0.1 ms, and it is established whether it is greater than limit v_min. The result of the comparison is output as Boolean variable B_vmin, in addition to further output variables s_i, v_i and t_i. Variable t_i indicates the instant for which variables s_i and v_i are valid. This instant is determined by instantaneous timer status t_Timer of "clock" 66 (FIG. 7).

The entire subcalculation 100 which supplies these results is performed in time-controlled fashion, here, illustratively, in the 0.1 ms clock pulse, in the time interval between events ev_start and ev_stop. Moreover, event ev_start triggers the initialization of memory location s_gev with the value 0, and event ev_stop triggers the saving of the last value v_gev_in memory location v_gev_e. As described, this value is made available here to a module 70 for the purpose of an adaptation or a superimposed cycle-based closed-loop control.

With that, the description of the third exemplary embodiment is concluded. It should be noted that combinations of the driving methods corrected according to the present invention on the basis of a positioning-travel feedback, with a purely model-based or program-map-based control of the valve lift are possible and useful in various respects.

For example, from case to case, i.e., given the presence of certain conditions such as the drop below a lift limit, it is possible to switch from a driving method according to the present invention to a purely model-based open-loop control. In this case, small valve lifts would be set in purely open-loop controlled fashion, whereas the control of opening operations with average and large resulting valve lifts would be corrected on the basis of a positioning-travel feedback according to the present invention. Likewise, emergency operation in the case of a disturbed sensor signal is possible in purely open-loop controlled fashion. The latter also represents a good reason, in addition to a control corrected according to the present invention with the aid of a positioning-travel feedback, to provide a sufficiently good, model-based open-loop control function, as well.

Furthermore, it is possible and advantageous that such a function, provided for example as backup system and using a pure open-loop control method, or a model of the actuator behavior contained therein, is evaluated at least every now and then in parallel/concurrently with a control method according to the present invention, to thereby detect changes of the actuator behavior in operation and to evaluate them along the lines of an actuator diagnostic. For example, the basis of such a diagnostic method may be the comparison of the last and therefore lift-determining correction value tm1_corr of a method according to the present invention, to the tm1_value from a model-based calculation with respect to the same lift l or l_setpoint.

In addition, it should be noted that the feedback of positioning travel s_gev used for a method according to the present invention may also be obtained indirectly on the basis of further sensor signals, e.g., from the signal of a differential-pressure sensor that measures the pressure drop and therefore the flow rate of oil via control valve MV1. From this, taking leakages on one hand and dynamic effects such as pressure pulsations on the other hand into suitable account, it is possible to determine the distance traveled by gas-exchange valve 1.

What is claimed is:

1. A method for controlling an actuator for a gas-exchange valve of an internal combustion engine, the internal combustion engine having at least one control valve for opening the valve and one control valve for closing the valve, each of the control valves being capable of being driven by at least one drive pulse whose duration determines a positioning travel of the valve, the valve being opened or closed, in one lift or a plurality of partial lifts, and at least one drive pulse being assigned to each lift or each partial lift, and the valve being assigned at least one transducer which generates at least one signal that discloses at least one of a discrete travel position of the valve at a specified time and a discrete instant at a specified travel position, the method comprising:

starting a drive pulse having a setpoint duration of the drive pulse for at least one of opening and closing the valve;

generating the at least one signal;

correcting in accordance with the at least one signal the setpoint duration of at least one of: i) a current drive pulse, and ii) a following drive pulse assigned to a partial lift, wherein each partial lift is one stage in a multi-staged opening or closing of the valve;

ascertaining repeatedly or continually a pair of values, including a mutually assigned instant and a positioning travel, and correcting the setpoint duration of a drive pulse based on at least one pair of ascertained values; and ascertaining a velocity of the valve at the instant, wherein at an instant during a drive pulse of the at least one control valve, a driving duration of the drive pulse is corrected in accordance with a corrected setpoint value.

2. The method as recited in claim 1, wherein the at least one signal is generated for each at least one of a lift and partial lift, and the duration of the drive pulse is corrected in accordance with the signal.

3. The method as recited in claim 1, further comprising:

ascertaining, based on the at least one signal, an associated travel position of the valve at at least one discrete instant.

4. The method as recited in claim 3, wherein the instant lies between drive pulses for two successive partial lifts of the valve.

5. The method as recited in claim 3, wherein the instant lies during a drive pulse of the at least one control valve for at least one of a lift and a partial lift of the valve.

6. The method as recited in claim 1, wherein the setpoint duration of a drive pulse is corrected on the basis of at least one of the discrete instant and the discrete travel position of the valve.

7. The method as recited in claim 1, further comprising:

determining at least one of i) a deviation of the discrete travel position from a setpoint value or anticipated value, or ii) a deviation of the discrete instant from a setpoint value or anticipated value, wherein the setpoint duration of a drive pulse is corrected based on the deviation.

8. The method as recited in claim 1, further comprising:

ascertaining repeatedly or continually a pair of values, including a mutually assigned instant and a travel position, and correcting of the setpoint duration of a drive pulse based on at least one pair of ascertained values.

9. The method as recited in claim 8, further comprising:

ascertaining a velocity of the valve at the instant.

10. The method as recited in claim 1, wherein the setpoint duration of the current drive pulse is corrected more than once over a duration of the current drive pulse.

11. A method for controlling an actuator for a gas-exchange valve of an internal combustion engine, the internal combustion engine having at least one control valve for opening the valve and one control valve for closing the valve, each of the control valves being capable of being driven by at least one drive pulse whose duration determines a positioning travel of the valve, the valve being opened or closed, in one lift or a plurality of partial lifts, and at least one drive pulse being assigned to each lift or each partial lift, and the valve being assigned at least one transducer which generates at least one signal that discloses at least one of a discrete travel position of the valve at a specified time and a discrete instant at a specified travel position, the method comprising:

starting a drive pulse having a setpoint duration of the drive pulse for at least one of opening and closing the valve;

generating the at least one signal;

correcting in accordance with the at least one signal the setpoint duration of at least one of: i) the drive pulse, ii) a following drive pulse assigned to a partial lift, wherein each partial lift is one stage in a multi-staged opening or closing of the valve;

ascertaining, based on the at least one signal, an associated travel position of the valve at at least one discrete instant, wherein the instant lies between drive pulses for two successive partial lifts of the valve;

ascertaining repeatedly or continually a pair of values, including a mutually assigned instant and a positioning travel, and correcting the setpoint duration of a drive pulse based on at least one pair of ascertained values; and ascertaining a velocity of the valve at the instant, wherein at an instant during a drive pulse of the at least one control valve, a driving duration of the drive pulse is corrected in accordance with a corrected setpoint value.

12. The method as recited in claim 1, wherein the transducer, at at least one discrete travel position of the valve, generates an event from which an associated instant is ascertained.

13. The method as recited in claim 12, wherein the event is a signal edge of an electrical signal or an electrical pulse.

14. A method for controlling an actuator for a gas-exchange valve of an internal combustion engine, the internal combustion engine having at least one control valve for opening the valve and one control valve for closing the valve, each of the control valves being capable of being driven by at least one drive pulse whose duration determines a positioning travel of the valve, the valve being opened or closed, in one lift or a plurality of partial lifts, and at least one drive pulse being assigned to each lift or each partial lift, and the valve being assigned at least one transducer which generates a signal that discloses values of a discrete positioning travel of the valve and of an assigned time or values of a discrete instant and of an assigned positioning travel, the method comprising:

starting a drive pulse having a setpoint duration of the drive pulse for at least one of opening and closing the valve;

generating at least one signal;

correcting in accordance with the signal the setpoint duration of at least one of: i) the drive pulse, ii) a following drive pulse assigned to the lift, and iii) a following drive pulse assigned to a partial lift;

ascertaining repeatedly or continually a pair of values, including a mutually assigned instant and a positioning travel, and correcting of the setpoint duration of a drive pulse based on at least one pair of ascertained values; and ascertaining a velocity of the valve at the instant, wherein:

at an instant during a drive pulse of the at least one control valve, a driving duration of the drive pulse is corrected in accordance with a corrected setpoint value, which is ascertained according to the formula $$tm1_corr = t_i - t_start + (l_setpoint - s_i)/v_i - dt_rt_eff;$$

t_start is a starting instant of the drive pulse;

l_setpoint is at least one of a setpoint value for the position determined by the drive pulse, and a setpoint value for the difference of the position determined by the drive pulse compared to the position on the positioning travel of the valve determined by a preceding drive pulse; and dt_rt_eff is an effective return-travel time of an armature of the at least one control valve.

15. The method as recited in claim 14, wherein the effective return-travel time is determined from parameters and a velocity of the valve after the drive pulse of the at least one control valve has ended, according to the following formula:

$$dt_rt_eff = C0 + C1 * v_gev_e.$$

16. The method as recited in claim 15, wherein the velocity is approached successively, an instantaneous value of the velocity being used as approximation at an instant.

17. The method as recited in claim 15, wherein the parameters are ascertained as a function of state variables of the actuator.

18. The method as recited in claim 15, wherein the parameters are ascertained from program maps.

19. An internal combustion engine, comprising:

at least one hydraulically actuated valve, the valve being assigned a transducer which generates an electrical signal, corresponding to a travel position of the valve; and an activator, the activator adapted to perform the following:

generating at least one signal, including the electrical signal corresponding to a travel position of the valve;

correcting in accordance with the at least one signal a setpoint duration of at least one of: i) a current drive pulse, and ii) a following drive pulse assigned to a partial lift, wherein each partial lift is one stage in a multi-staged opening or closing of the valve;

an ascertaining arrangement to ascertain repeatedly or continually a pair of values, including a mutually assigned instant and a positioning travel, and to correct the setpoint duration of a drive pulse based on at least one pair of ascertained values; and an ascertaining arrangement to ascertain a velocity of the valve at the instant, wherein at an instant during a drive pulse of the at least one control valve, a driving duration of the drive pulse is corrected in accordance with a corrected setpoint value.

20. The engine as recited in claim 19, wherein the hydraulically actuated valve is a gas-exchange valve that is acted upon by hydraulic pressure by a control valve on a high-pressure side and a control valve on the low-pressure side, and thus is able to be opened and closed.

21. The engine as recited in claim 20, wherein the control valve on the high-pressure side and the control valve on the low-pressure side are electrically driven.

22. The engine as recited in claim 21, wherein the opening of the control valve on the high-pressure side while control valve on the low-pressure side is in a closed state causes the gas-exchange valve to open, and the opening of the control valve on the low-pressure side while the control valve on the high-pressure side is in the closed state causes the gas-exchange valve to close.

23. The engine as recited in claim 20, wherein each of the control valves is capable of being driven by at least one drive pulse whose duration determines the travel position of the valve, the valve being opened/closed in at least one of one lift or a plurality of partial lifts, and at least one drive pulse being assigned to the at least one lift or partial lift, and the transducer generating a signal that discloses at least one of a discrete travel position of the valve and an assigned time, or a discrete instant and an assigned travel position.

24. The internal combustion engine as recited in claim 19, wherein the setpoint duration of the current drive pulse is corrected more than once over a duration of the current drive pulse.

25. A control unit for controlling a gas exchange valve of an internal combustion engine, the internal combustion engine having at least one control valve for opening the valve and one control valve for closing the valve, comprising:

a control unit arrangement adapted to perform the following:

starting a drive pulse having a setpoint duration of the drive pulse for at least one of opening and closing the valve;

generating at least one signal that discloses at least one of a discrete travel position of the valve at a specified time and a discrete instant at a specified travel position; and correcting in accordance with the at least one signal the setpoint duration of at least one of i) a current drive pulse, and ii) a following drive pulse assigned to a partial lift, wherein each partial lift is one stage in a multi-staged opening or closing of the valve, wherein each of the control valves is capable of being driven by at least one drive pulse whose duration determines a travel position of the valve, the valve being opened or closed, in one lift or a plurality of partial lifts, and at least one drive pulse is assigned to each lift or each partial lift, and the valve is assigned at least one transducer which generates the at least one signal;

an ascertaining arrangement to ascertain repeatedly or continually a pair of values, including a mutually assigned instant and a positioning travel, and to correct the setpoint duration of a drive pulse based on at least one pair of ascertained values; and an ascertaining arrangement to ascertain a velocity of the valve at the instant, wherein at an instant during a drive pulse of the at least one control valve, a driving duration of the drive pulse is corrected in accordance with a corrected setpoint value.

26. The control unit as recited in claim 25, wherein the setpoint duration of the current drive pulse is corrected more than once over a duration of the current drive pulse.

* * * * *